US008827711B2

(12) United States Patent
Davis, II et al.

(10) Patent No.: US 8,827,711 B2
(45) Date of Patent: Sep. 9, 2014

(54) DECORATIVE OBJECT ARRANGEMENT DEVICE AND METHOD FOR UTILIZING THE SAME

(75) Inventors: James T. Davis, II, Springville, UT (US); Jared Burton, Payson, UT (US); Rebecca Sego, Spanish Fork, UT (US); Jeffrey V. Gubler, Springville, UT (US); Randall J. Benson, Cedar Hills, UT (US)

(73) Assignee: Provo Craft and Novelty, Inc., South Jordan, UT (US)

( * ) Notice: Subject to any disclaimer, the term of this patent is extended or adjusted under 35 U.S.C. 154(b) by 786 days.

(21) Appl. No.: 12/895,421

(22) Filed: Sep. 30, 2010

(65) Prior Publication Data

US 2011/0073519 A1 Mar. 31, 2011

Related U.S. Application Data

(60) Provisional application No. 61/247,349, filed on Sep. 30, 2009.

(51) Int. Cl.

| | |
|---|---|
| ***G09B 19/00*** | (2006.01) |
| ***B65D 1/34*** | (2006.01) |
| ***B07C 7/00*** | (2006.01) |

(52) U.S. Cl.
CPC .... *B65D 1/34* (2013.01); *B07C 7/00* (2013.01)
USPC ..... 434/96

(58) Field of Classification Search
USPC ..... 434/81–83, 95, 96, 112–115, 365; 40/446, 449, 450; 273/236; 345/55, 59; 446/85, 105, 118, 219
See application file for complete search history.

(56) References Cited

U.S. PATENT DOCUMENTS

| | | | | |
|---|---|---|---|---|
| 4,986,756 | A * | 1/1991 | Yamaguchi | 434/96 |
| 5,121,926 | A * | 6/1992 | Pfaender | 273/236 |
| 5,174,757 | A * | 12/1992 | Jones | 434/96 |
| 5,207,793 | A * | 5/1993 | Brand et al. | 273/445 |
| 5,324,224 | A * | 6/1994 | Anderson et al. | 446/91 |
| 6,028,582 | A * | 2/2000 | Drew et al. | 345/108 |
| 6,032,393 | A * | 3/2000 | Maxim | 40/548 |
| 6,691,533 | B2 * | 2/2004 | Feuer | 63/26 |
| 6,729,932 | B2 * | 5/2004 | Jarvis | 446/219 |
| 7,214,118 | B1 * | 5/2007 | Maxim | 446/118 |
| 7,390,237 | B2 * | 6/2008 | Lin | 446/118 |

OTHER PUBLICATIONS

Web page "DAS Stone Stencil Rhinestone Heat Transfer System" (www.digitalartsolutions.com).
Web page "Motif Tool Set" (http://colmanandcompany.com).
Web page "Professional Rhinestone Setting Machine for Bedazzler Rhinestones" (http://valcala.com).
Web page "e-nygma" (www.e-nygma.com).
Web page "VHS-350 Manual Rhinestone Setting Machine" (www.mesadist.com).
Web page "Glitz Rhinestone Setter Bedzzzler Setting Machine Be Dazzler" (http://valcala.com).
Web page "EndlessLiberoM6" (www.rhinestonemachine.com).

* cited by examiner

*Primary Examiner* — Kurt Fernstrom
(74) *Attorney, Agent, or Firm* — Honigman Miller Schwartz and Cohn LLP

(57) ABSTRACT

An arrangement device is disclosed. The arrangement device includes a tray portion having a body that forms a plurality of passages. The arrangement device also includes a plurality of pattern adjustment plungers movably-secured to the tray portion within the plurality of passages.

22 Claims, 39 Drawing Sheets

D
12
16
14
32
26
34
36
H1
T1
4
4
30
24
28
10
18
44
50
48
54
46
20
22

D
12
134
136
114
32
126
164
116
30
124
100
18
20
22

DECORATIVE OBJECT ARRANGEMENT DEVICE AND METHOD FOR UTILIZING THE SAME

RELATED APPLICATIONS

This Application claims the benefit of U.S. Provisional Application 61/247,349 filed on Sep. 30, 2009, which is entirely incorporated herein by reference.

FIELD OF THE INVENTION

The disclosure relates to decorative object arrangement devices and methods for utilizing the same.

DESCRIPTION OF THE RELATED ART

For thousands of years, people have been captivated by the aesthetic qualities of gemstones, precious metals and the like (hereinafter, "jewelry"). However, due to an associated desirability, jewelry, in general, is known to be rather expensive. As such, persons that may not have the resources to fashion themselves with expensive jewelry have looked to alternative, plentifully-inexpensive, decorative objects to fulfill their desires.

Although such alternative, plentifully-inexpensive, decorative objects are acceptable for the purpose of inexpensively providing fashion to a person, some alternative, plentifully-inexpensive, decorative objects may be rather small such that a selective, "by hand"/manual/unassisted/arrangement of a plurality of the alternative, plentifully-inexpensive, decorative objects is time consuming and/or cumbersome. Therefore, a need exists in the art for the development of a device and method for utilizing the same that overcomes the above-addressed problems.

BRIEF DESCRIPTION OF THE DRAWINGS

The disclosure will now be described, by way of example, with reference to the accompanying drawings, in which:

FIGS. 18-20B illustrate a method for resetting an axial orientation of one or more of the pattern adjustment plungers from a depressed orientation to a non-depressed orientation in accordance with an exemplary embodiment of the invention;

DETAILED DESCRIPTION OF THE INVENTION

The Figures illustrate an exemplary embodiment of a decorative object arrangement device and method for utilizing the same in accordance with an embodiment of the invention. Based on the foregoing, it is to be generally understood that the nomenclature used herein is simply for convenience and the terms used to describe the invention should be given the broadest meaning by one of ordinary skill in the art.

Figure 1A:
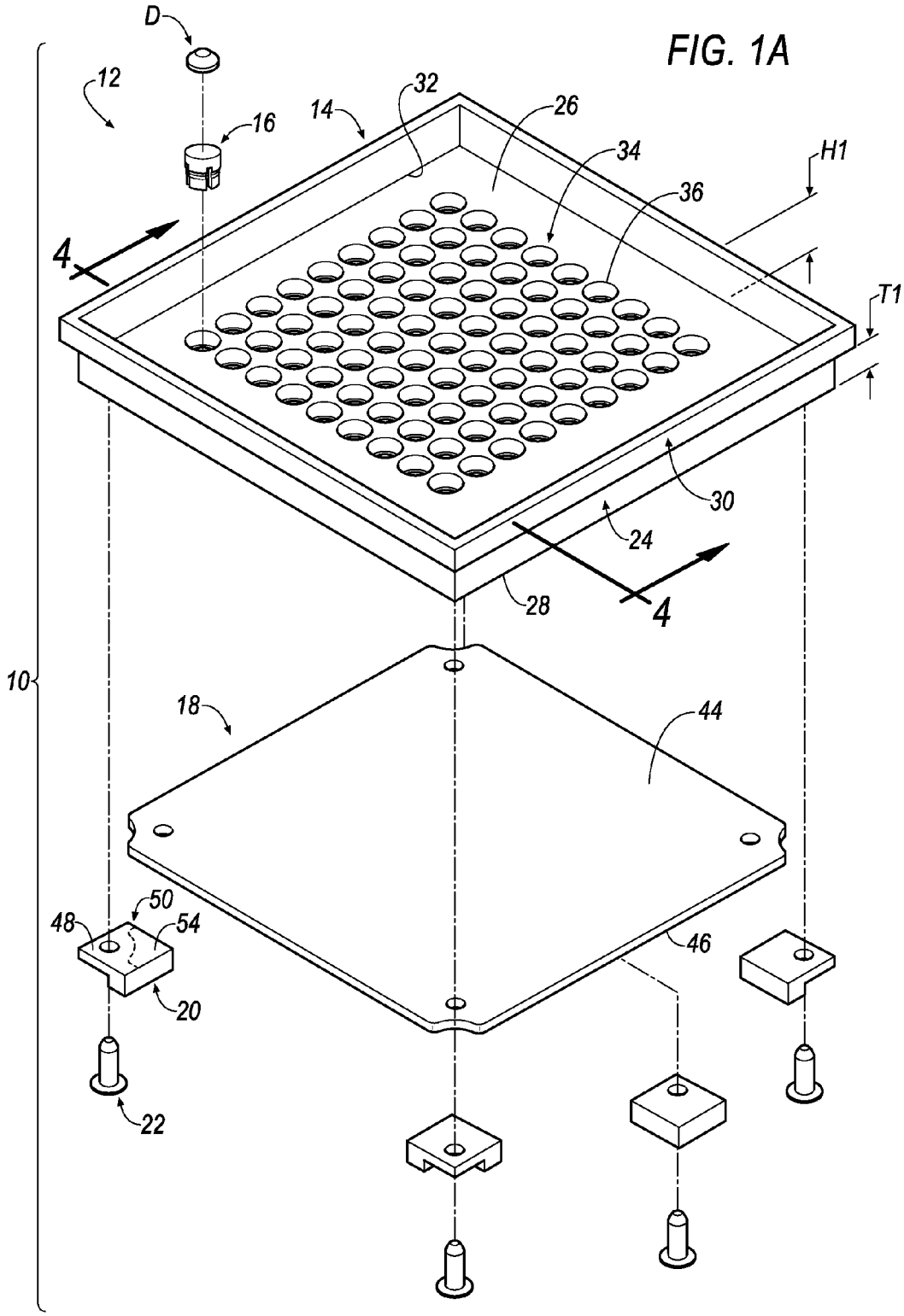
FIG. 1A is a top exploded view of a decorative object arrangement device in accordance with an exemplary embodiment of the invention.
Figure 1B:
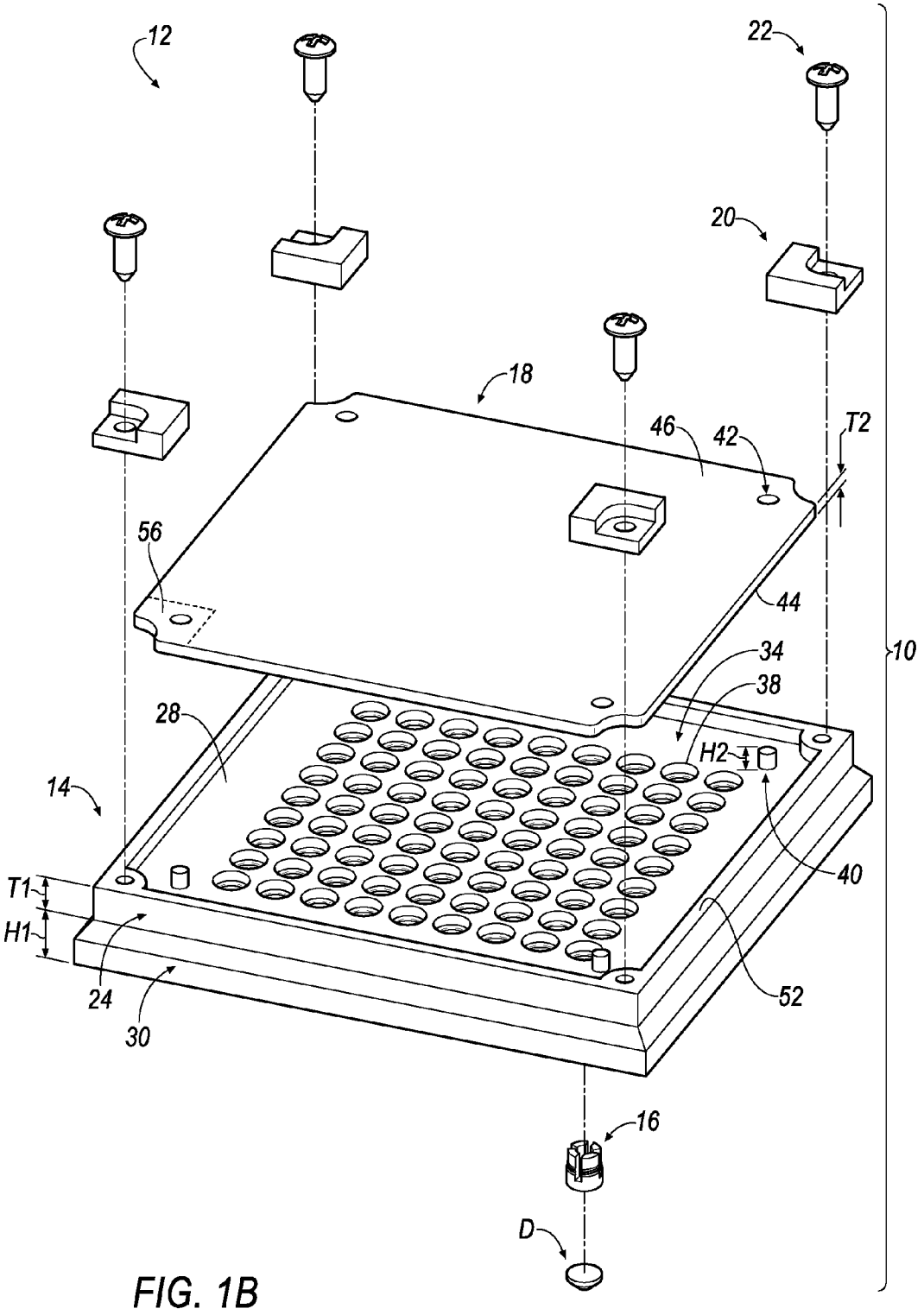
FIG. 1B is a bottom exploded view of the decorative object arrangement device of FIG. 1A in accordance with an exemplary embodiment of the invention.

Referring to FIGS. 1A and 1B, an exploded view of a decorative object arrangement device is shown generally at 10 according to an embodiment of the invention. In an embodiment, the decorative object arrangement device 10 may include a plurality of components 12. In an embodiment, the plurality of components 12 may include a tray portion 14, a plurality of pattern adjustment plungers 16, a plunger reset plate 18, a plurality of reset plate retaining members 20 and a plurality of fasteners 22.

In an embodiment, the tray portion 14 includes a body 24 having a thickness, T1, that is bound by an upper surface 26 and a lower surface 28 of the body 24. In an embodiment the tray portion 14 also includes a lip portion 30 that extends away from the upper surface 26 at a height, H1.

In an embodiment, the body 24 is square-shaped. In an embodiment, the lip portion 30 is also square-shaped and completely encloses an outer perimeter 32 of the upper surface 26. Although the body 24 and lip portion 30 are described to be square-shaped, it will be appreciated that the body 24 and lip portion 30 are not limited to a square shape and may include any desirable shape, configuration or the like.

In an embodiment, the body 24 may form a plurality of passages 34 that extend through the thickness, T1. In an embodiment, access to each of the passages 34 may be provided at an upper opening 36 (see, e.g., FIG. 1A) formed in the upper surface 26 and a lower opening 38 (see, e.g., FIG. 1B) formed in the lower surface 28.

Figure 2A:
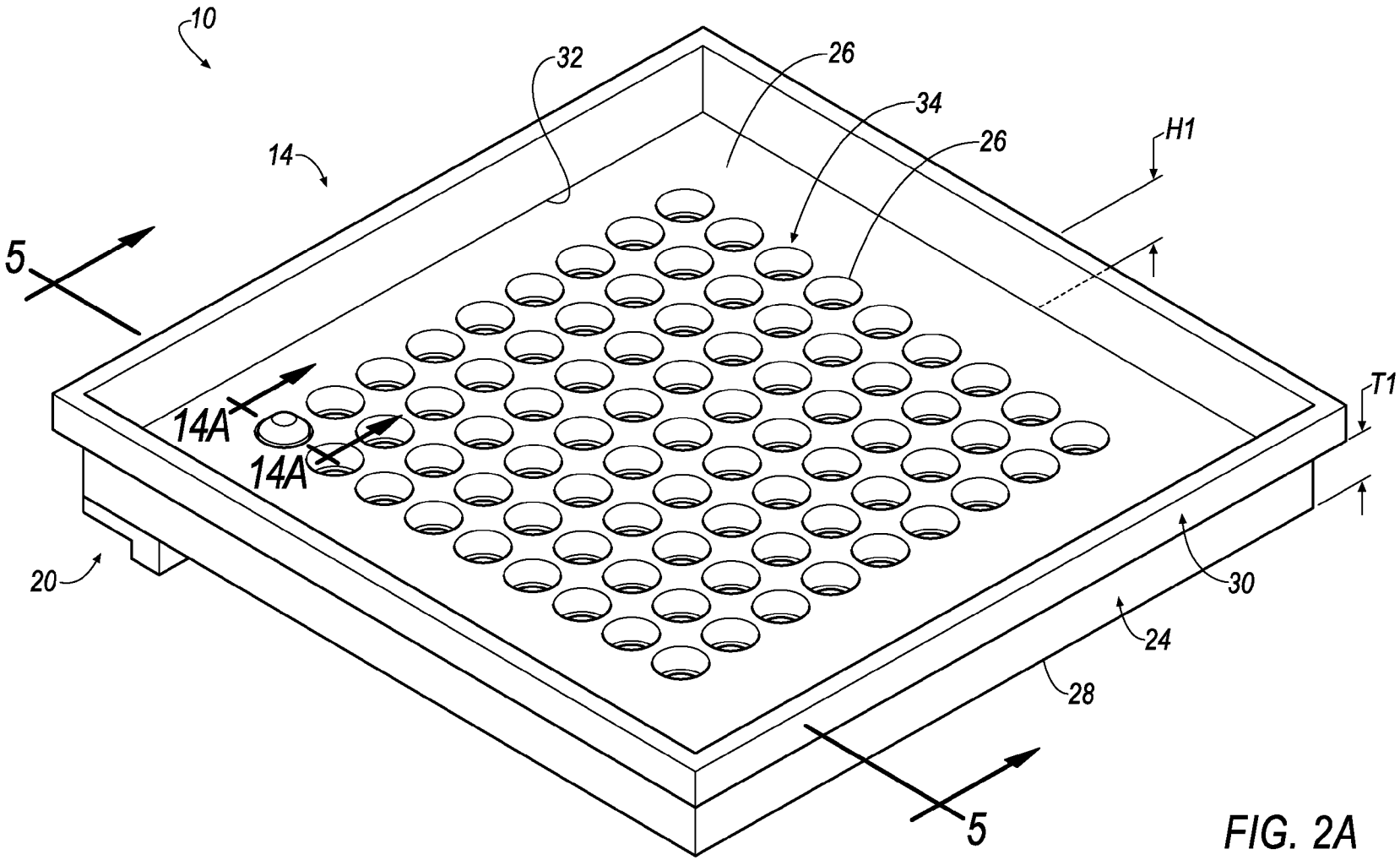
FIG. 2A is a top, assembled perspective view of the decorative object arrangement device of FIG. 1A in accordance with an exemplary embodiment of the invention.
Figure 2B:
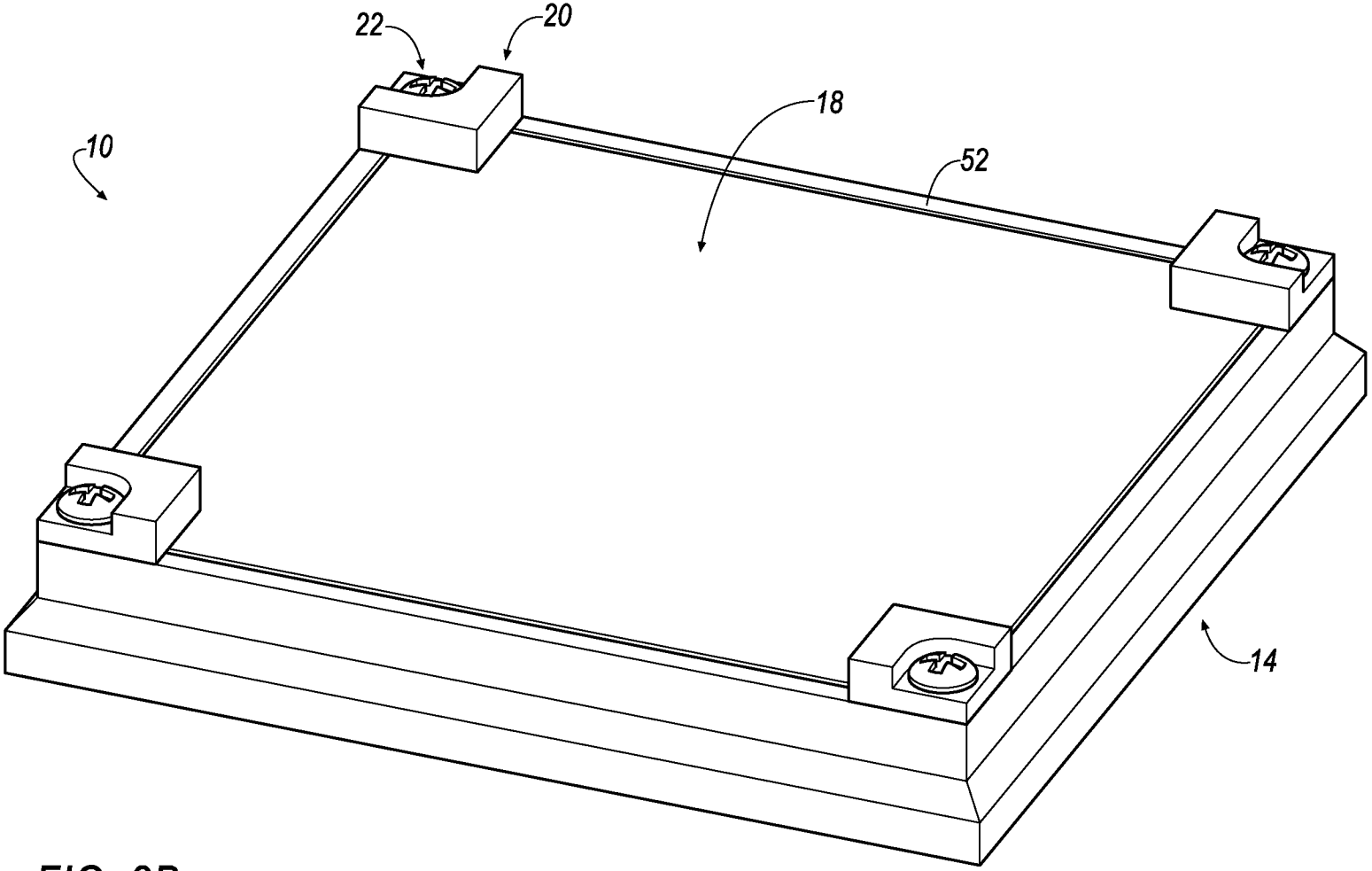
FIG. 2B is a bottom, assembled perspective view of the decorative object arrangement device of FIG. 1A in accordance with an exemplary embodiment of the invention.

Referring now to FIGS. 2A and 2B, the plunger reset plate 18 is shown secured proximate the lower surface 28 of the tray portion 14. In an embodiment, to secure the plunger reset plate 18 to the tray portion 14, as best seen in FIG. 1B, a fastener 22 passes through a passage formed in a retaining member 20 and is further passed through a passage formed in the tray portion 14 for rigidly-securing the retaining members 20 to the tray portion 14. When the retaining members 20 are rigidly secured to the tray portion 14 as described above with the fastener 22, the retaining members 20 and are located proximate and at least partially cover corners of the plunger reset plate 18. Further, as will be described in the foregoing disclosure at FIGS. 18-20B, the plunger reset plate 18 is secured between the tray portion 14 and the retaining members 20 such that the plunger reset plate 18 is movably-secured relative the tray portion 14 and retaining members 20.

Figure 5A:
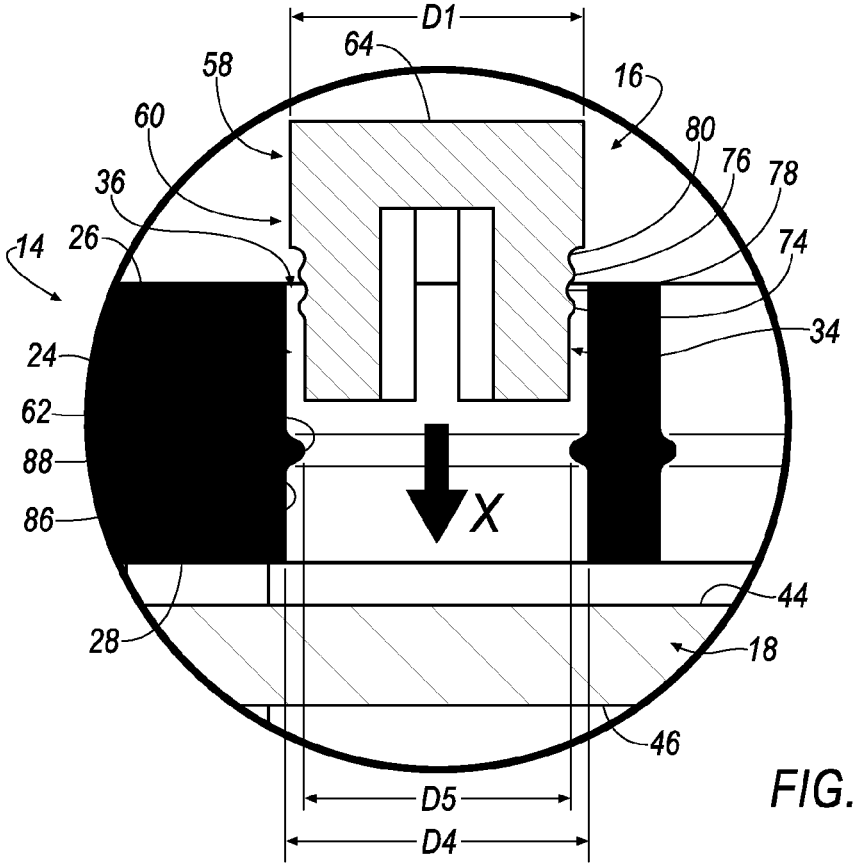
FIG. 5A is an enlarged cross-sectional view according to line 5 of FIG. 4 in accordance with an exemplary embodiment of the invention.
Figure 5B:
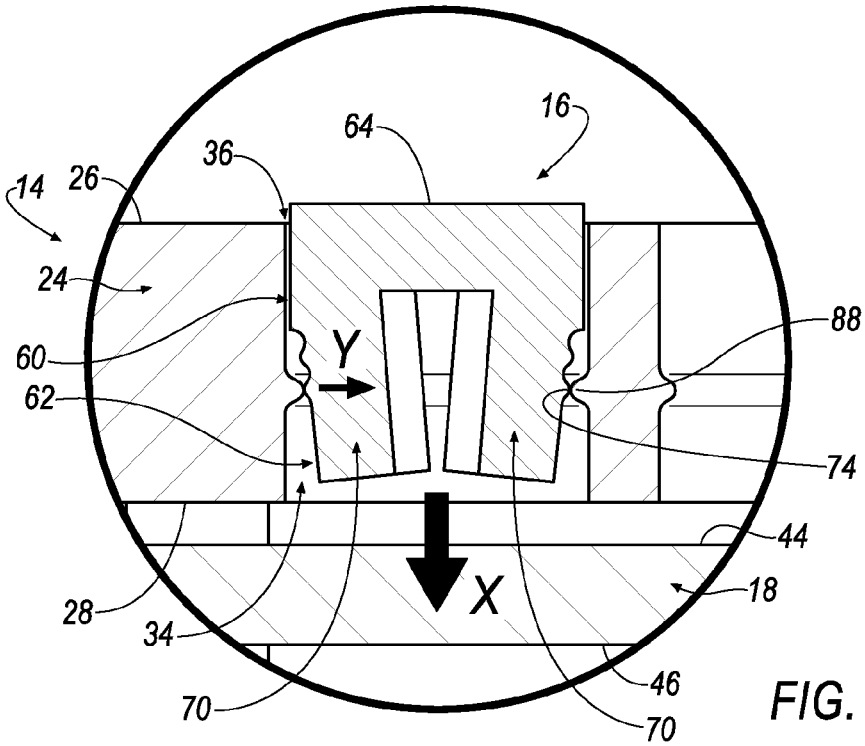
FIG. 5B is an enlarged cross-sectional view according to FIG. 5A showing an change in axial orientation of the pattern adjustment plunger as the pattern adjustment plunger is joined to a tray portion of the decorative object arrangement device in accordance with an exemplary embodiment of the invention.
Figure 5C:
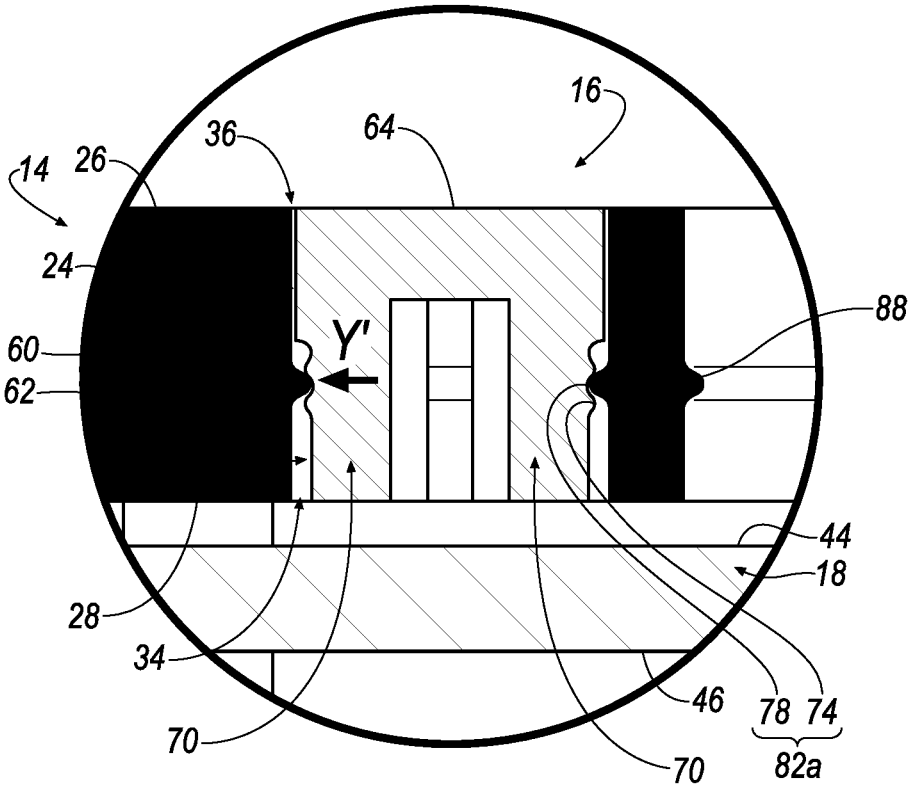
FIG. 5C is an enlarged cross-sectional view according to FIG. 5B showing an change in axial orientation of the pattern adjustment plunger as the pattern adjustment plunger is joined to the tray portion of the decorative object arrangement device in accordance with an exemplary embodiment of the invention.

Referring to FIGS. 1A and 1B, in an embodiment, a pattern adjustment plunger 16 is correspondingly disposed in each passage 34 by way of the upper opening 36 (see also, e.g., FIGS. 5A-5C). When the fasteners 22 secure the plunger reset plate 18 and plurality of retaining members 20 to the tray portion 14, and, when the plurality of pattern adjustment plungers 16 are disposed within the passages 34, the decorative object arrangement device 10 may be said to be in an assembled form as seen in FIGS. 2A and 2B.

Referring to FIG. 1B, prior to/as the plunger reset plate 18 is secured to the tray portion 14 as described above, locating pins 40 extending away from the lower surface 28 of the body 24 are aligned with and are subsequently inserted into passages 42 formed in the plunger reset plate 18. In an embodiment, each of the locating pins 40 may include a height, H2, that is greater than a thickness, T2, of the plunger reset plate 18 that is bound by an upper surface 44 and a lower surface 46 of the plunger reset plate 18. Once the locating pins 40 are extended through each of the passages 42, the upper surface 44 of the plunger reset plate 18 may be disposed in an opposing relationship with, but not necessarily always adjacent to, the lower surface 28 of the body 24.

Referring to FIG. 1A, prior to/as the plunger reset plate 18 is secured to the tray portion 14 as described above, a first portion 48 of an upper surface 50 of the reset plate retaining members 20 are located adjacent a portion of a mounting surface 52 (see, e.g., FIGS. 1B, 2B) that extends away from the lower surface 28 of the body 24. Further, in an embodiment, as seen in FIG. 1A, a second portion 54 of the upper surface 50 of each of the reset plate retaining members 20 may be disposed in an opposing relationship with, but not necessarily always adjacent to, a portion 56 (see, e.g., FIG. 1B) of the lower surface 46 of the reset plunger plate 18. In an embodiment, as seen in FIG. 1B, the portion 56 of the lower surface 46 of the reset plunger plate 18 is generally demarcated by a dashed line and generally refers to a corner of the reset plunger plate 18.

As will be explained in the foregoing disclosure at FIGS. 18-20B, due to the greater height, H2, of the locating pins 40 when compared to the thickness, T2, of the plunger reset plate 18, the plunger reset plate 18 may be said to be in a movable/"free floating" arrangement about the locating pins 40 between the second portion 54 of the upper surface 50 of each of the reset plate retaining members 20 and the lower surface 28 of the body 24. As will be explained in the foregoing disclosure at FIGS. 18-20B, the purpose of the movable/"free floating" arrangement of the plunger reset plate 18 may result in one or more pattern adjustment plungers 16 located within the passages 34 to be axially adjusted from a depressed state (see, e.g., FIG. 6B) to a non-depressed state (see, e.g., FIG. 6A) by moving the plunger rest plate 18 away from the second portion 54 of the upper surface 50 of the retaining members 20 and toward the lower surface 28 of the body 24 such that the upper surface 44 of the plunger reset plate 18 comes into contact with a lower surface 66 of one or more of the pattern adjustment plungers 16.

Figure 11:
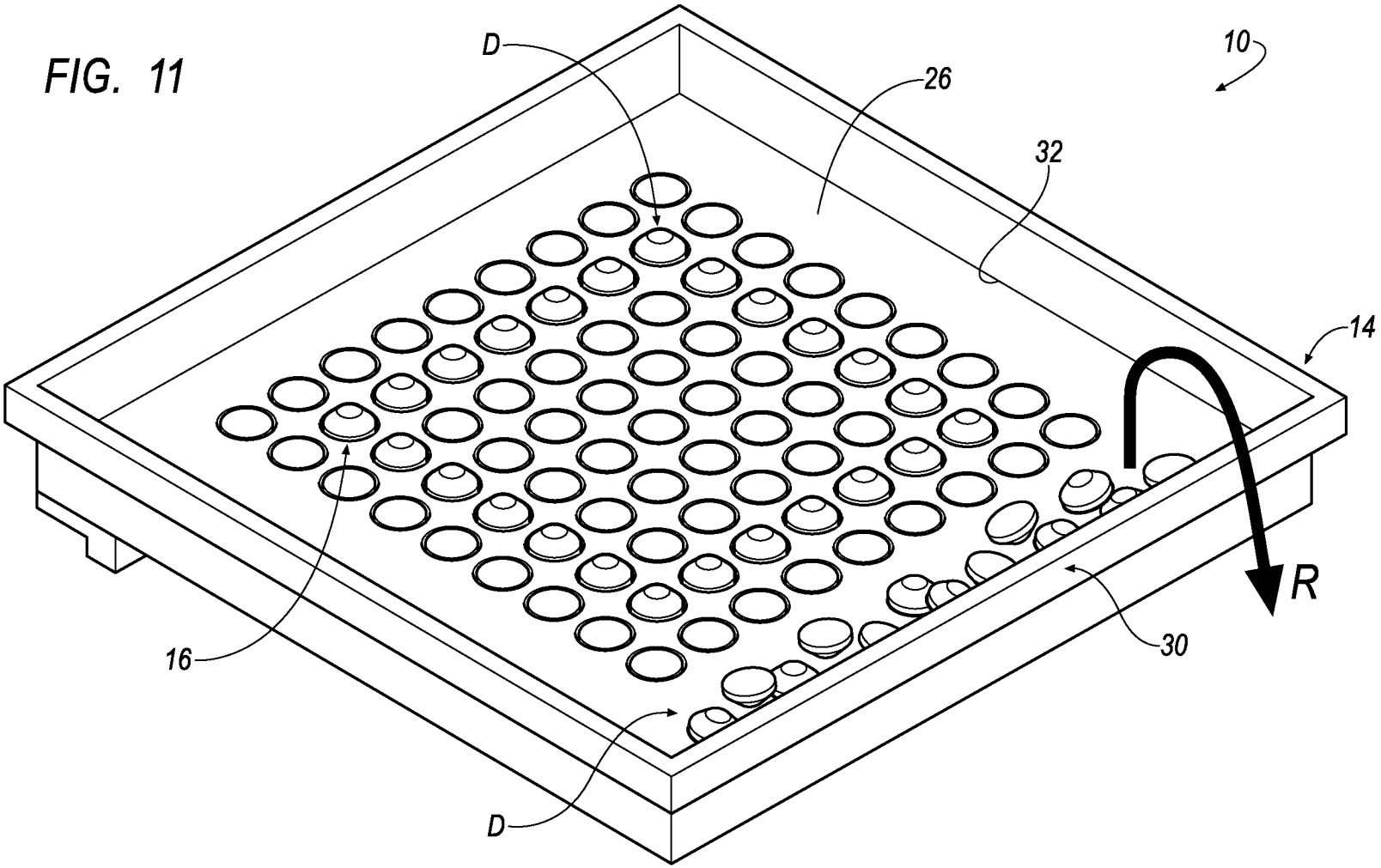
FIG. 11 is a top, assembled perspective view of the decorative object arrangement of FIG. 9 showing some of the plurality of decorative objects arranged in a predetermined pattern in accordance with an exemplary embodiment of the invention.

In an embodiment, as will be explained in the foregoing disclosure, the decorative object arrangement device 10 may be utilized to selectively arrange a plurality of decorative objects, D, in a predetermined pattern (see, e.g., FIG. 11). Further, as will be explained in the foregoing disclosure, the orientation of one or more the plurality of components 12 (e.g., one or more pattern adjustment plungers 16) of the decorative object arrangement device 10 may be selectively manipulated (see, e.g., FIGS. 6A-6B) in order to selectively arrange the decorative object arrangement device 10 in a manner to arrange the decorative objects, D, in one of a plurality of unique, predetermined patterns.

Figure 3:
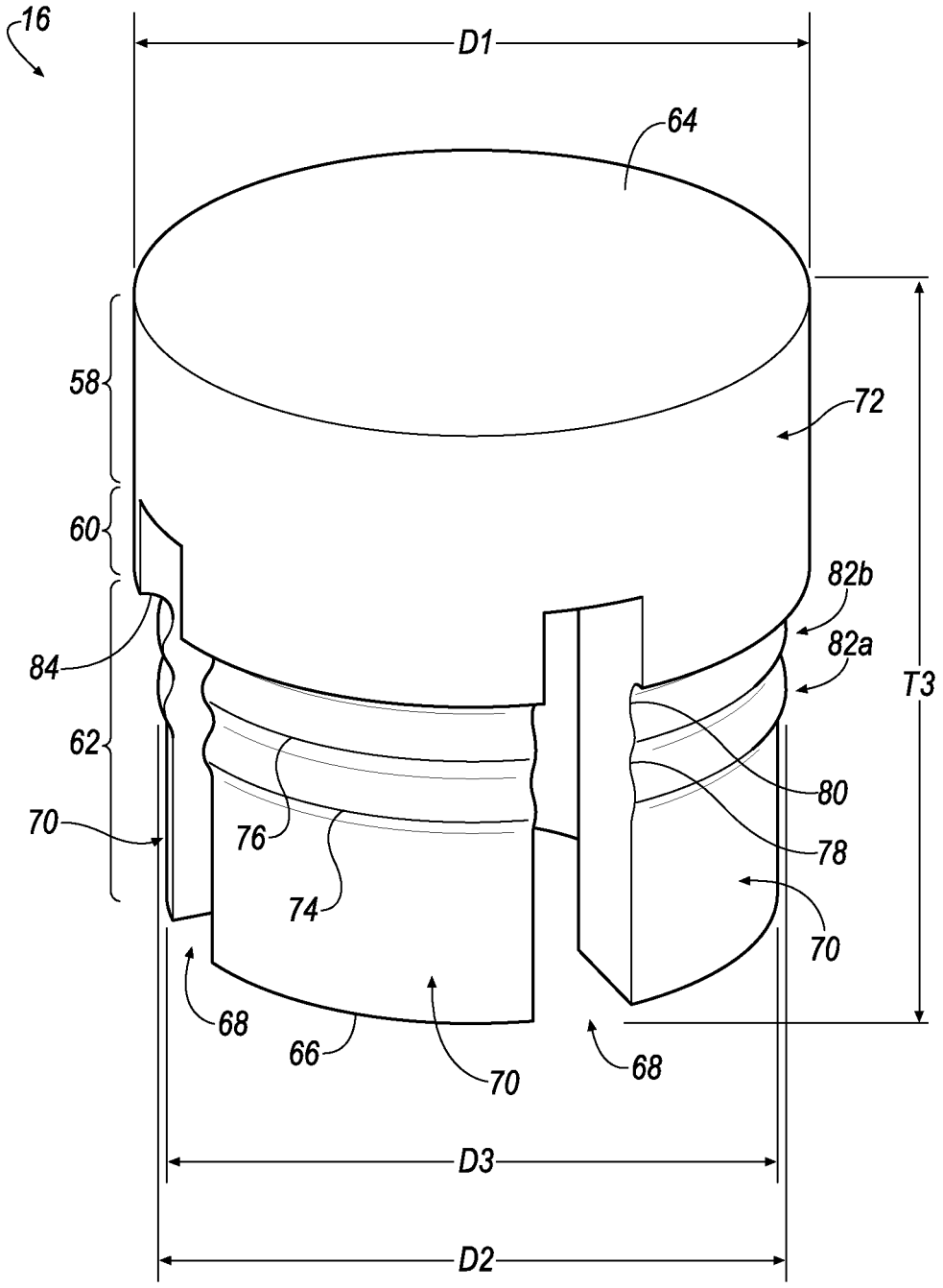
FIG. 3 is a perspective view of a pattern adjustment plunger of the decorative object arrangement device of FIGS. 1A-2B in accordance with an exemplary embodiment of the invention.

As discussed above, in order to arrange the decorative object arrangement device 10 in a manner to provide the decorative objects, D, in one of a plurality of unique, predetermined patterns, an axial orientation of one or more of a plurality of pattern adjustment plungers 16 may have to be manipulated relative to their positioning within the passages 34 of the tray portion 14. As seen in FIG. 3, an enlarged view of a pattern adjustment plunger 16 is shown according to an embodiment of the invention. In an embodiment, the pattern adjustment plunder 16 includes a substantially cylindrical shape that corresponds to the shape of the passages 34 provided by the tray portion 14.

In an embodiment, the pattern adjustment plunger 16 includes a head portion 58, a shoulder portion 60 and a neck portion 62 defining a thickness, T3, bound by an upper surface 64 and a lower surface 66 of the pattern adjustment plunger 16. In an embodiment, the thickness, T3, of the pattern adjustment plunger 16 is approximately equal to the thickness, T2, of the body 24 of the tray portion 14.

In an embodiment, the pattern adjustment plunger 16 includes several radial passages 68 extending radially through the pattern adjustment plunger 16 from the lower surface 66 and through the neck portion 62 and shoulder portion 60. Accordingly, in an embodiment, the passages 68 may form the neck portion 62 and shoulder portion 60 to define a plurality of flexible tab portions 70 at least proximate the shoulder portion 60 and neck portion 62.

The pattern adjustment plunger 16 also includes a substantially circumferential side surface 72 extending between the upper surface 64 and the lower surface 66. In an embodiment, the substantially circumferential side surface 72 proximate the head portion 58 is substantially uninterrupted and includes no recesses, projections or the like. In an embodiment, the substantially circumferential side surface 72 proximate the shoulder portion 60 is substantially similar to the head portion 58 in that the substantially circumferential side surface 72 of the shoulder portion 60 is also substantially uninterrupted and includes no recesses, projections or the like. In an embodiment, the head portion 58 and the shoulder portion 60 define the pattern adjustment plunger 16 to include a first diameter, D1.

In an embodiment, the substantially circumferential side surface 72 proximate the neck portion 62 includes an interrupted surface formed by first and second peaks 74, 76 and first and second valleys 78, 80. In an embodiment, the first peak 74 and first valley 78 form a first tactile-feedback portion 82*a* and the second peak 76 and second valley 80 form a second tactile-feedback portion 82*b*.

In an embodiment, the neck portion 62 defines the pattern adjustment plunger 16 to include a second diameter, D2, and a third diameter, D3. In an embodiment, the second diameter, D2, is defined by the first and second peaks 74, 76. In an embodiment, the third diameter, D3, is defined by the first and second valleys 78, 80. In an embodiment, the second diameter, D2, is approximately the same as, but slightly greater than the third diameter, D3.

In an embodiment, the first diameter, D1, is greater than each of the second diameter, D2, and the third diameter, D3. Because the first diameter, D1 is greater than each of the second diameter, D2, and the third diameter, D3, the substantially circumferential side surface 72 further includes a shoulder surface 84 that connects the uninterrupted side surface 72 of the shoulder portion 60 with the interrupted side surface 72 of the neck portion 62.

Figure 4:
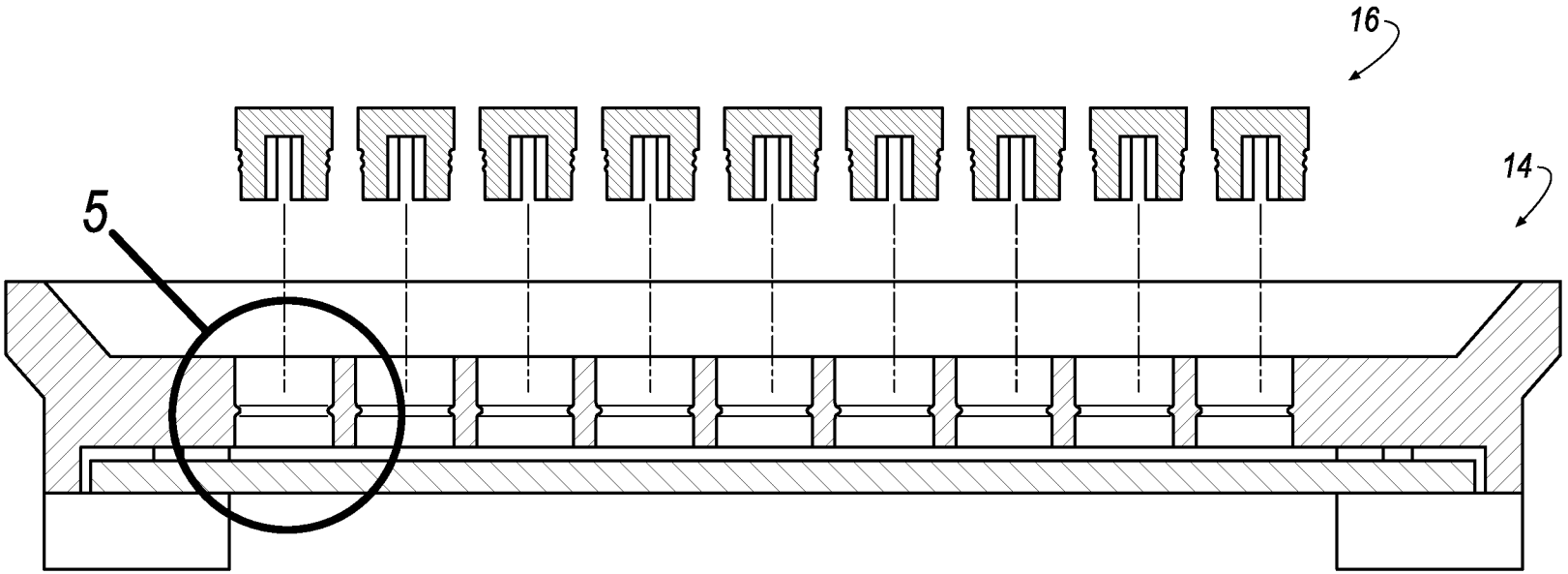
FIG. 4 is a cross-sectional view of the decorative object arrangement device and pattern adjustment plunger according to line 4-4 of FIG. 1A in accordance with an exemplary embodiment of the invention.

Referring now to FIGS. 4-5C, a view illustrating the attachment of the pattern adjustment plungers 16 to the tray portion 14 is shown according to an embodiment. Firstly, as seen in FIG. 5A, the neck portion 62 of the pattern adjustment plunger 16 is inserted into the upper opening 36 of the passage 34 according to the direction of the arrow, X.

Referring still to FIG. 5A, in an embodiment, a wall surface 86 of each of the passages 34 is interrupted to include a substantially annular, radially-inwardly projecting ledge 88. In an embodiment, the wall surface 86 defines the passage 34 to include a first opening diameter, D4, that is approximately the same as, but slightly greater than the diameter, D1, of the head portion 58 and shoulder portion 60. In an embodiment, the substantially annular, radially-inwardly projecting ledge 88 defines the passage 34 to include a second opening diameter, D5, that is approximately the same as, but slightly less than the diameter, D2, of the neck portion 62 that is defined by the first and second peaks 74, 76. Further, in an embodiment, the second opening diameter, D5, is approximately the same as, but slightly greater than the diameter, D3, of the neck portion 62 that is defined by the first and second valleys 78, 80.

Referring to FIG. 5B, as the pattern adjustment plunger 16 is inserted into the passage 34 according to the direction of the arrow, X, the first peak 74 (which includes a greater diameter, D2, than the second diameter opening, D5, of the passage 34 at the substantially annular, radially-inwardly projecting ledge 88) comes into contact with the substantially annular, radially-inwardly projecting ledge 88. As the first peak 74 "rides over" the substantially annular, radially-inwardly projecting ledge 88 as the pattern adjustment plunger 16 is further inserted into the passage 34 according to the direction of the arrow, X, the plurality of flexible tab portions 70 formed by one or more of the neck portion 62 and shoulder portion 60 are permitted to deflect radially inwardly according to the direction of the arrow, Y.

Referring to FIG. 5C, as the pattern adjustment plunger 16 is further inserted into the passage 34 according to the direction of the arrow, X, the first peak 74 completely "rides over" the substantially annular, radially-inwardly projecting ledge 88 such that the substantially annular, radially-inwardly projecting ledge 88 becomes seated within the first valley 78. Upon seating the substantially annular, radially-inwardly projecting ledge 88 within the first valley 78, an operator pushing the pattern adjustment plunger 16 into the passage 34 according to the direction of the arrow, X, may feel/hear the plurality of flexible tab portions 70 snapping back radially outwardly according to the direction of the arrow, Y', to their pre-insertion state (see, e.g., FIG. 5A), thereby defining the "tactile-feedback quality" of the first tactile-feedback portion 82*a* defined by the first peak 74 and first valley 78.

Upon locating the pattern adjustment plunger 16 relative the passage 34 as described above in FIG. 5C, the upper surface 64 of the pattern adjustment plunger 16 is substantially co-planar with the upper surface 26 of the tray portion 14, thereby "closing out" and substantially denying access to any portion of the passage 34 by way of the upper opening 36 at the upper surface 26. It will be appreciated, however, that further axial manipulation of the orientation of the pattern adjustment plunger 16 may be conducted in order to obtain access to at least a portion of the passage 34 by way of the upper opening 36, as will be described in the foregoing disclosure.

Figure 6A:
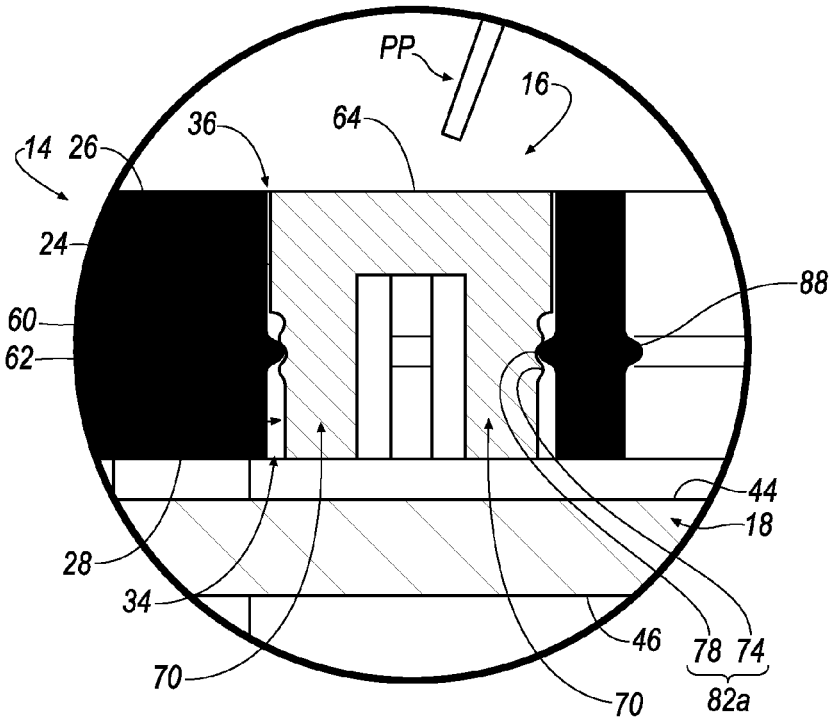
FIGS. 6A-6B illustrate enlarged cross-sectional views according to FIG. 5C showing a selective change in axial orientation of the pattern adjustment plunger relative the tray portion of the decorative object arrangement device by utilizing a push-pin to depress the pattern adjustment plunger in accordance with an exemplary embodiment of the invention.
Figure 6B:
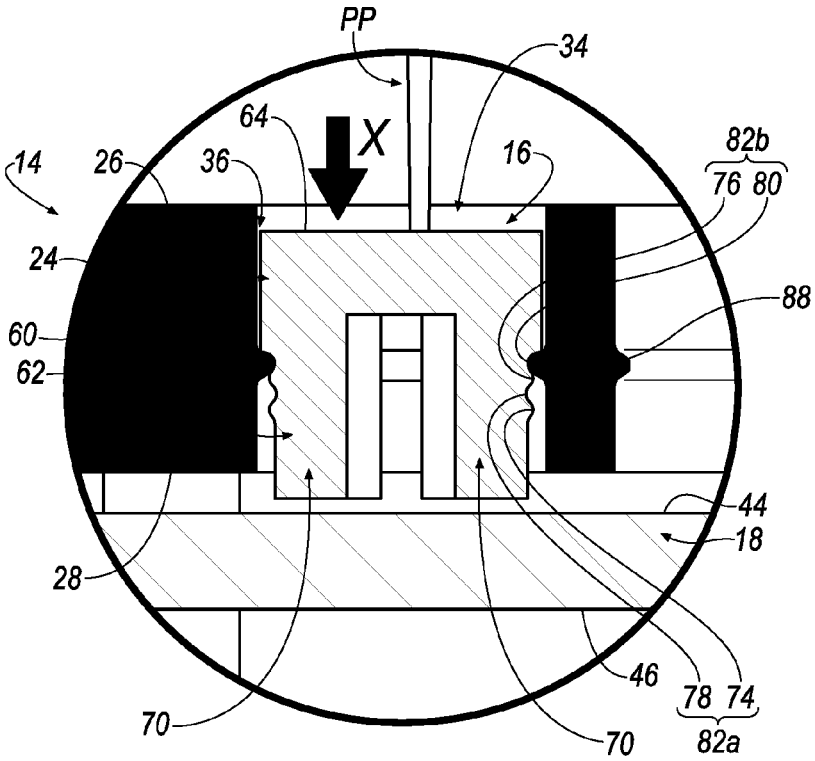

Referring now to FIGS. 6A-6B, the axial orientation of one or more the plurality of pattern adjustment plungers 16 may be selectively manipulated. As seen in FIG. 6A, a user may utilize, for example, a push-pin, PP, or the like in order to contact and apply a force toward the upper surface 64 of one or more pattern adjustment plungers 16 for axially depressing the one or more pattern adjustment plungers 16 according to the direction of the arrow, X. As seen in FIG. 6B, by axially depressing the pattern adjustment plunger 16, access to at least a portion of the passage 34 by way of the upper opening 36 is provided as described above. Further, as seen in FIG. 6B, when axially moved with the push-pin, PP, as described above, the substantially annular, radially-inwardly projecting ledge 88 may become seated within the second valley 80 of the second tactile-feedback portion 82*b* such that the user may feel/hear the plurality of flexible tab portions 70 being moved radially inwardly, Y, then outwardly, Y', as similarly described above with respect to the first tactile-feedback portion 82*a*.

In an embodiment, the utilization of the push-pin, PP, as described above may be carried out by a user in a completely random manner such that the user may selectively decide which pattern adjustment plungers 16 to depress for locating in a depressed state (see, e.g., FIG. 6B) and which ones to leave in the un-depressed state (see, e.g., FIG. 6A). Alternatively, as seen in FIGS. 7A and 8A, the user may place a sheet, S, containing a predetermined pattern, P, over the upper surface 26 of the tray portion 14.

In an embodiment, the sheet, S, may include an outer perimeter, OP, that corresponds to the outer perimeter 32 of the upper surface 26. In an embodiment, the predetermined pattern, P, includes markings or passages that are aligned with some of the passages 34 in order to provide a visual aid to a user as to which pattern adjustment plungers 16 are designated for axial depression. Further, as seen in FIGS. 7B and 8B, it will be appreciated that when the sheet, S, is placed adjacent the upper surface 26, the lip portion 30 prevents the sheet, S, from shifting or deviating from an alignment position with the pattern adjustment plungers 16 that are to be depressed.

Figure 7A:
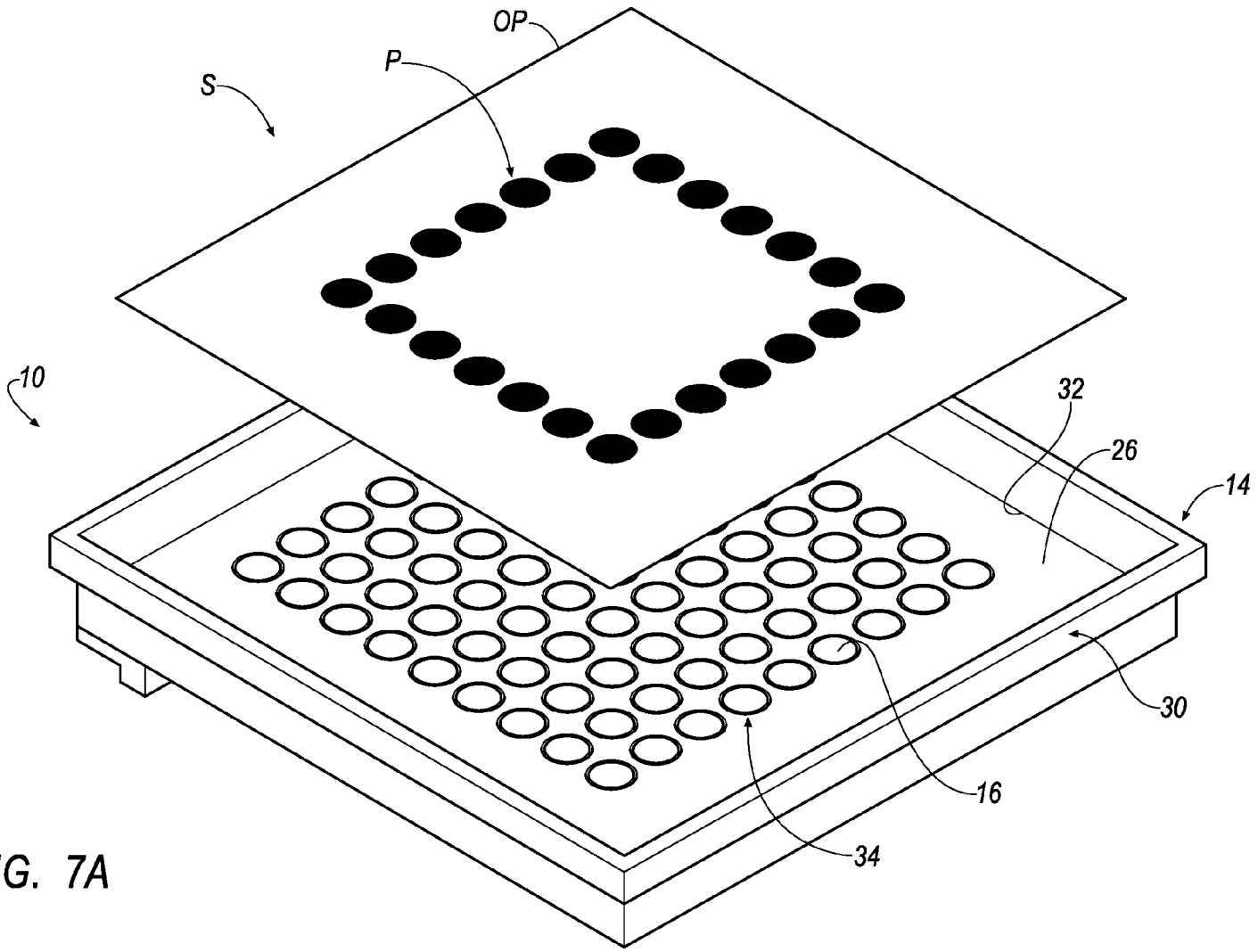
FIG. 7A is top, assembled perspective view of the decorative object arrangement device of FIG. 2A including a pattern template sheet positioned above the decorative object arrangement device in accordance with an exemplary embodiment of the invention.
Figure 7B:
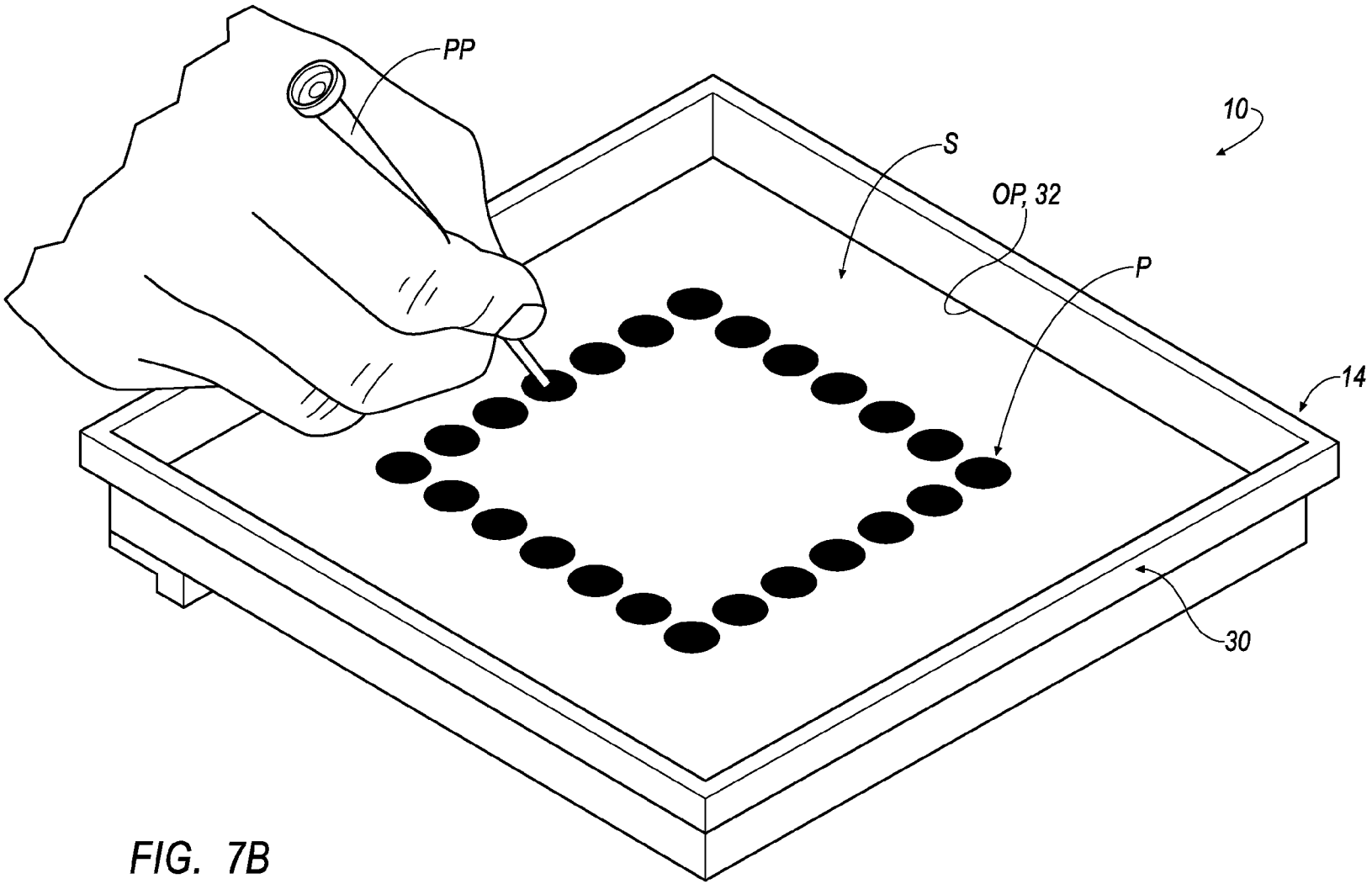
FIG. 7B is top, assembled perspective view of the decorative object arrangement device of FIG. 2A including a pattern template sheet positioned adjacent the decorative object arrangement device in accordance with an exemplary embodiment of the invention.
Figure 8A:
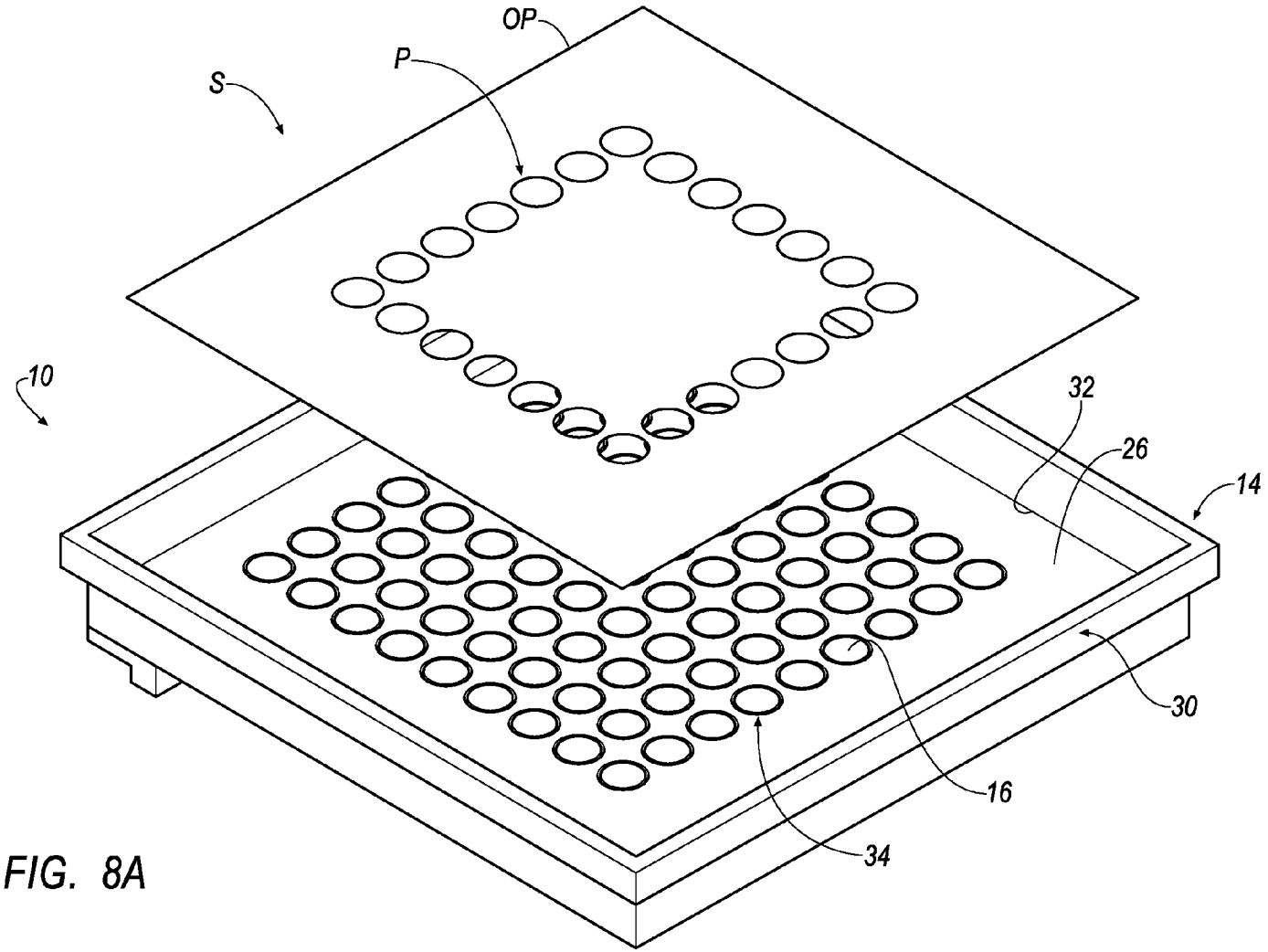
FIG. 8A is top, assembled perspective view of the decorative object arrangement device of FIG. 2A including a pattern template sheet positioned above the decorative object arrangement device in accordance with an exemplary embodiment of the invention.
Figure 8B:
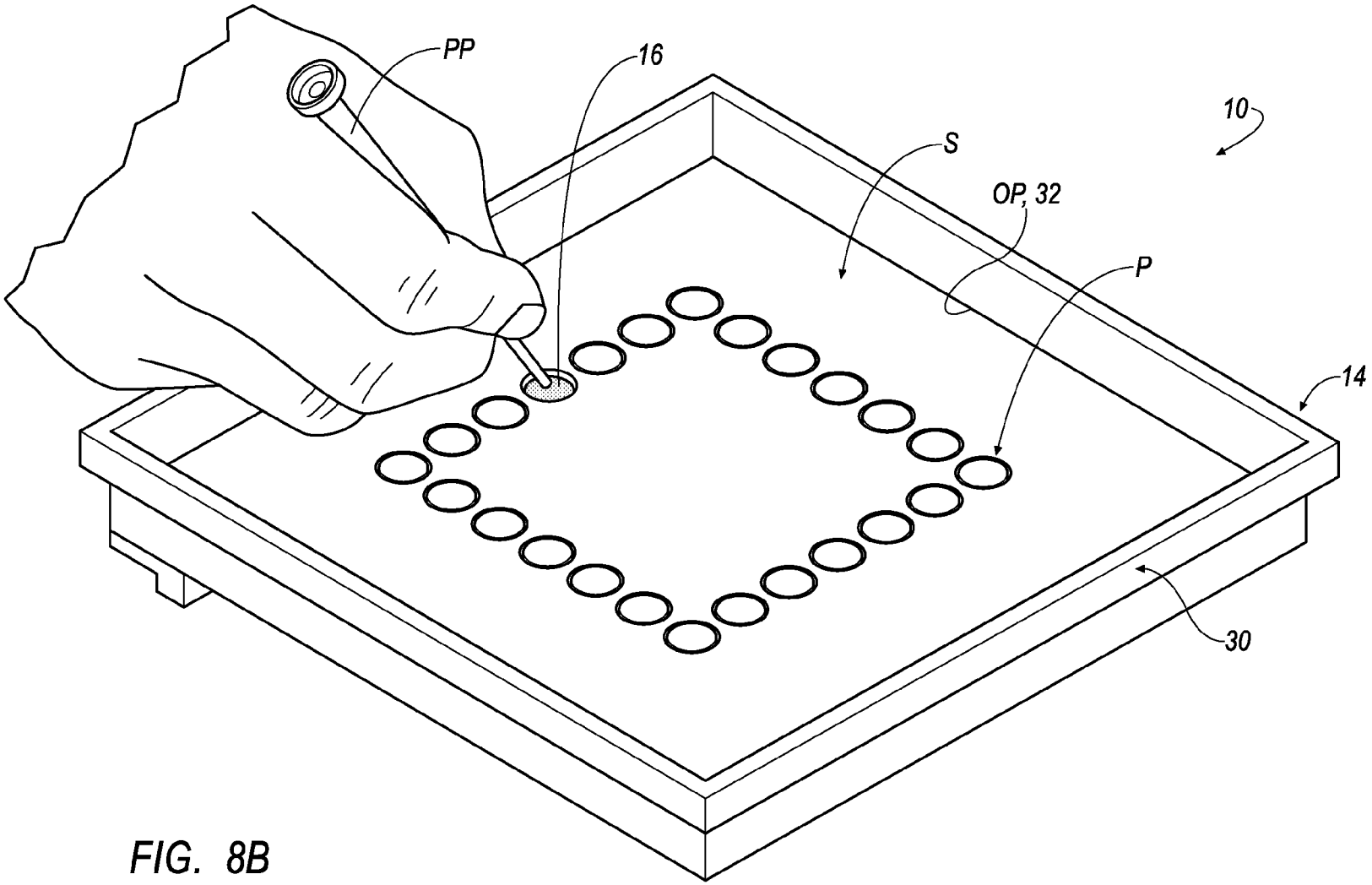
FIG. 8B is top, assembled perspective view of the decorative object arrangement device of FIG. 2A including a pattern template sheet positioned adjacent the decorative object arrangement device in accordance with an exemplary embodiment of the invention.

In an embodiment, the pattern, P, of the sheet, S, of FIGS. 7A-7B may be printed to define, for example, a plurality of dots arranged in a square-shaped pattern. In an embodiment, the pattern, P, of the sheet, S, of FIGS. 8A-8B may be die-cut such that the sheets, S, includes a plurality of openings arranged in a square-shaped pattern. As, such, it will be appreciated that the sheet, S, of FIGS. 7A-7B permits a user to indirectly engage the upper surface 64 of the pattern adjustment plungers 16 whereas the sheet, S, of FIGS. 8A-8B permits a user to directly engage the upper surface 64 of the pattern adjustment plungers 16 by inserting the push-pin, PP, through the die-cut openings defining the pattern, P.

Figure 9:
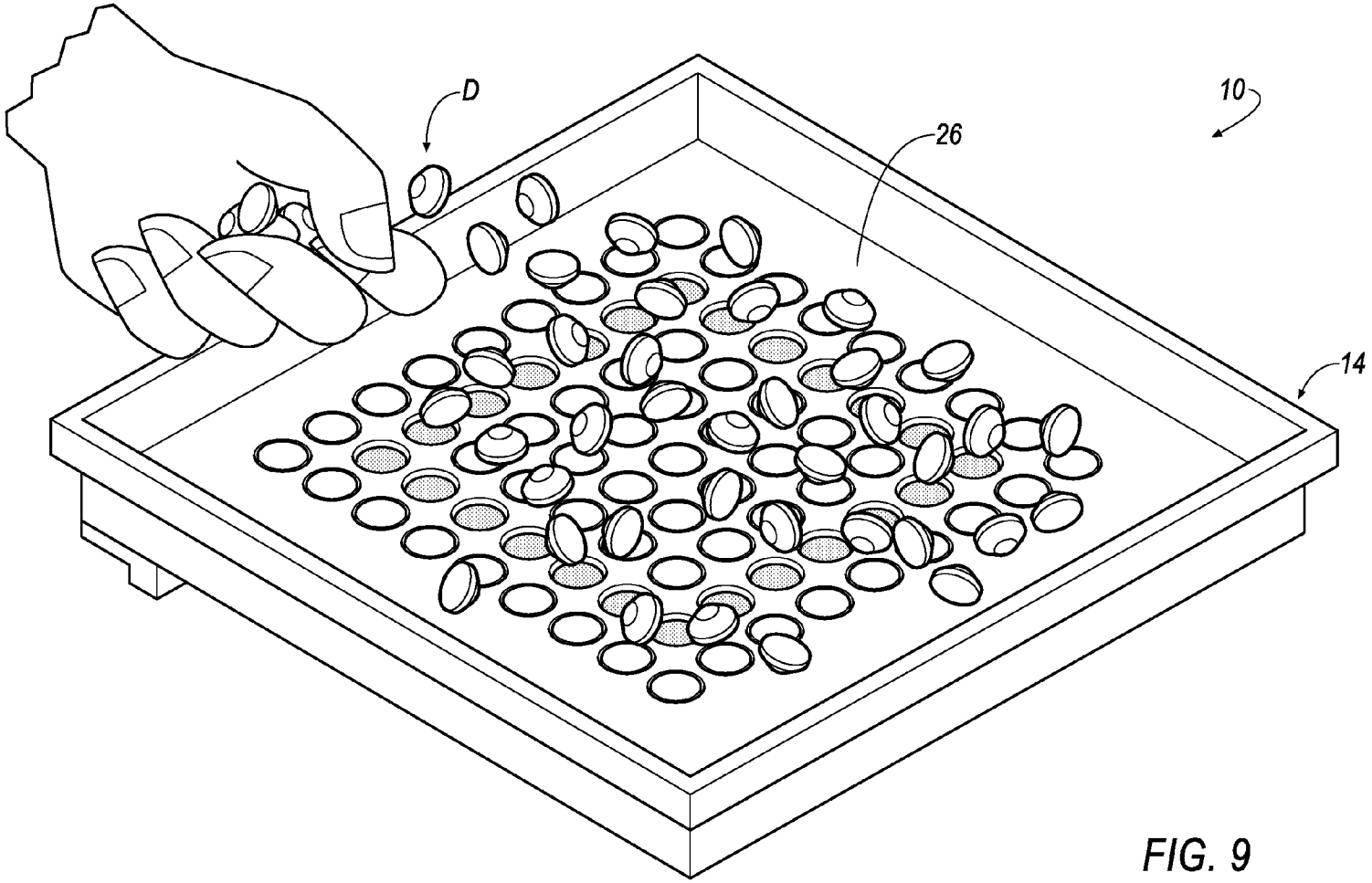
FIG. 9 is a top, assembled perspective view of the decorative object arrangement device of FIG. 2A and a plurality of decorative objects being randomly disposed upon the decorative object arrangement device in accordance with an exemplary embodiment of the invention.

Once the user has selectively depressed some of the pattern adjustment plungers 16, the sheet, S, may be removed from the upper surface 26 of the tray portion 14, thereby exposing the remaining un-depressed pattern adjustment plungers 16 whose upper surface 64 is still substantially co-planar with the upper surface 26 of the tray portion 14. Referring to FIG. 9, depressed pattern adjustment plungers 16 include a shaded/gray surface characteristic at the upper surface 64 whereas the non-depressed pattern adjustment plungers 16 include a non-shaded/white surface characteristic.

As seen in FIG. 9, the user may dispose a plurality of decorative objects, D, upon the upper surface 26 of the tray portion 14. In an embodiment, the plurality of decorative objects, D, may include an amount that is more than the number of depressed pattern adjustment plungers 16. As such, as will be explained in the foregoing disclosure at FIG. 11, when all of the depressed pattern adjustment plungers 16 are paired with some of the plurality of decorative objects, D, the remaining "unpaired" decorative objects, D, may be removed, R, from the decorative object arrangement device 10.

Figure 10A:
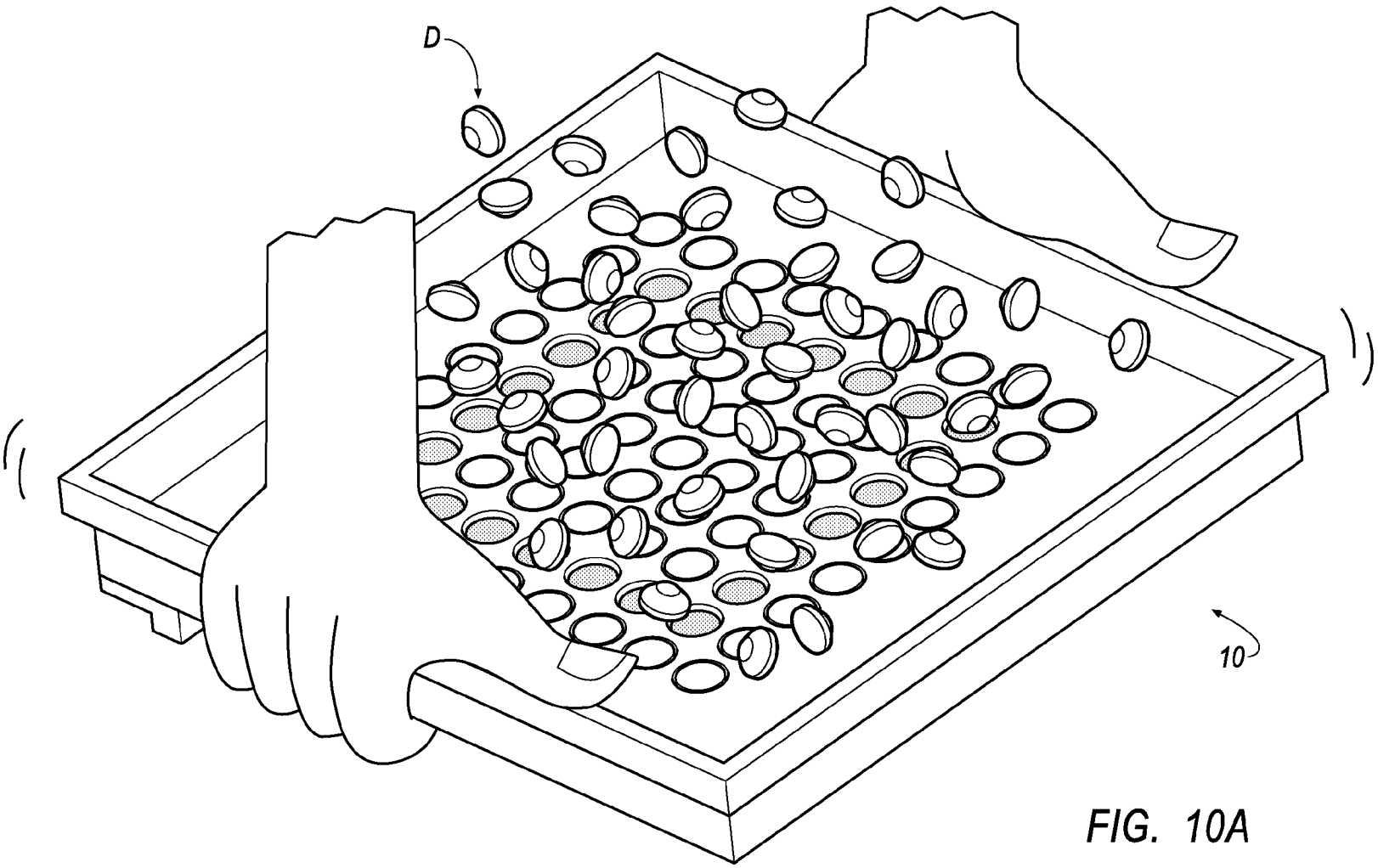
FIG. 10A is a top, assembled perspective view of the decorative object arrangement of FIG. 9 showing a user upsetting the orientation of the plurality of decorative objects in accordance with an exemplary embodiment of the invention.
Figure 10B:
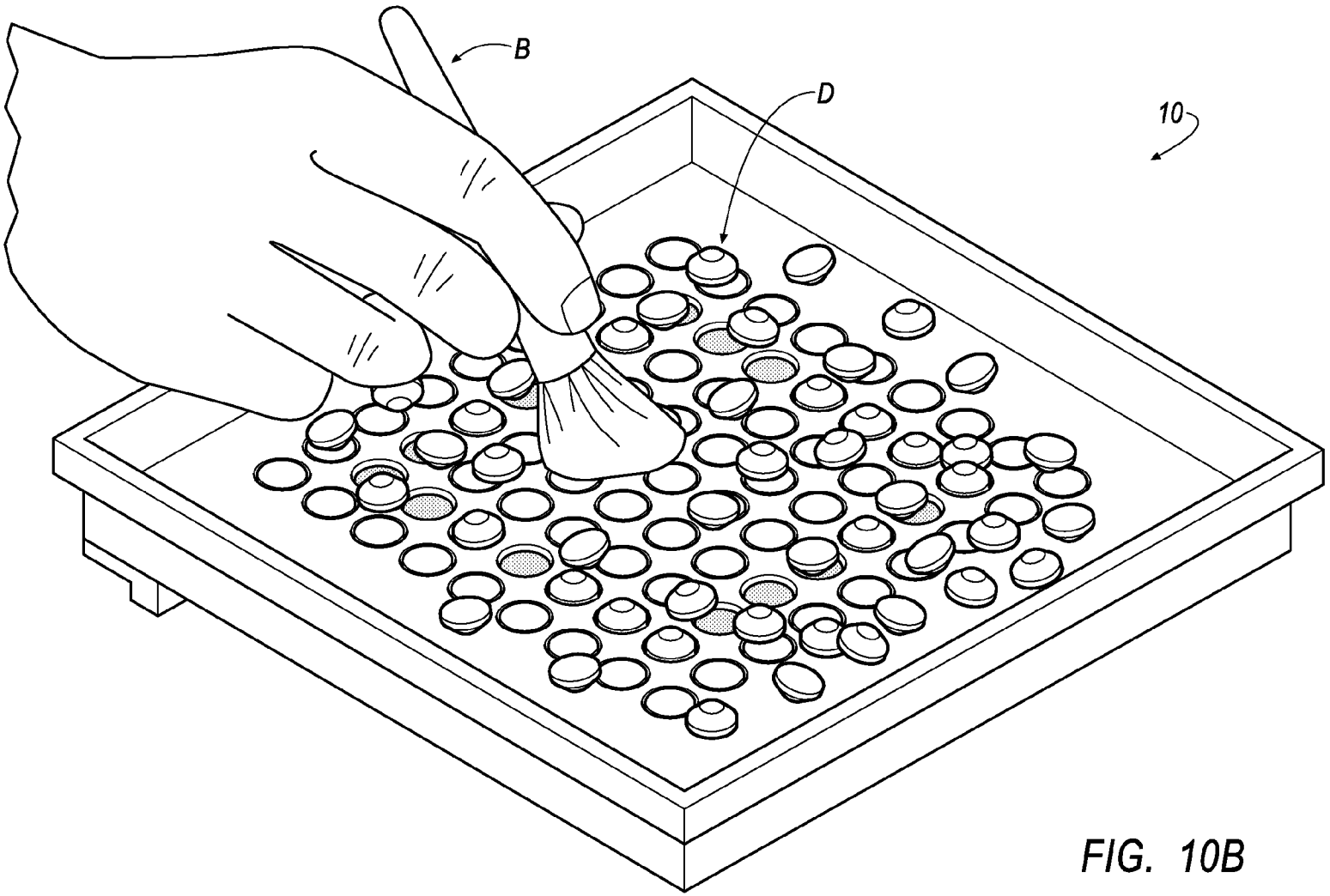
FIG. 10B is a top, assembled perspective view of the decorative object arrangement of FIG. 9 showing a user upsetting the orientation of the plurality of decorative objects in accordance with an exemplary embodiment of the invention.

As seen in FIGS. 10A and 10B, once the plurality of decorative objects, D, are placed on the decorative object arrangement device 10, the user may adjust the orientation of the plurality of decorative objects, D, by, for example, vibrating (with the assistance of a vibrating device—not shown)/shaking (manually by hand, as seen, e.g., in FIG. 10A) the decorative object arrangement device 10 and/or moving a brush, B, across the upper surface 26 for brushing (see, e.g., FIG. 10B) the decorative objects, D. As seen in FIG. 11, once some of the plurality of decorative objections, D, have been paired with all of the depressed pattern adjustment plungers 16, the remaining decorative objects, D, are moved toward the perimeter 32 of the upper surface 26 and adjacent the lip portion 30 for subsequent removal, R, from the decorative object arrangement device 10.

Figure 12A:
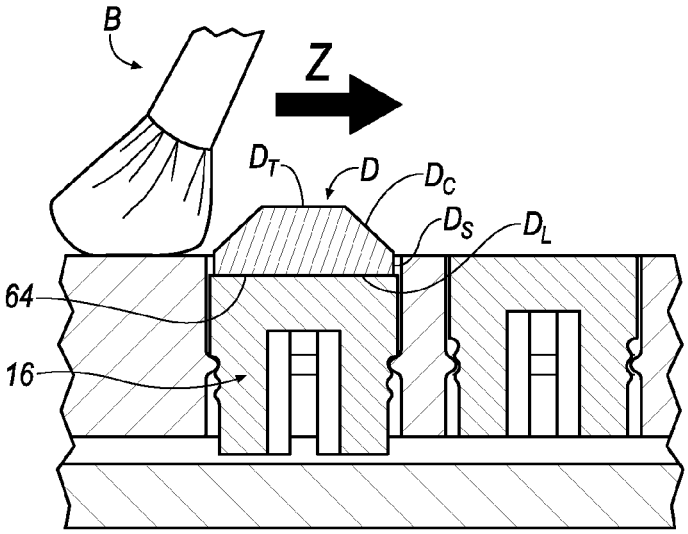
FIGS. 12A-13E illustrate a method for arranging the predetermined pattern of decorative objects of FIG. 11 in a right-side-up orientation in accordance with an exemplary embodiment of the invention.
Figure 12B:
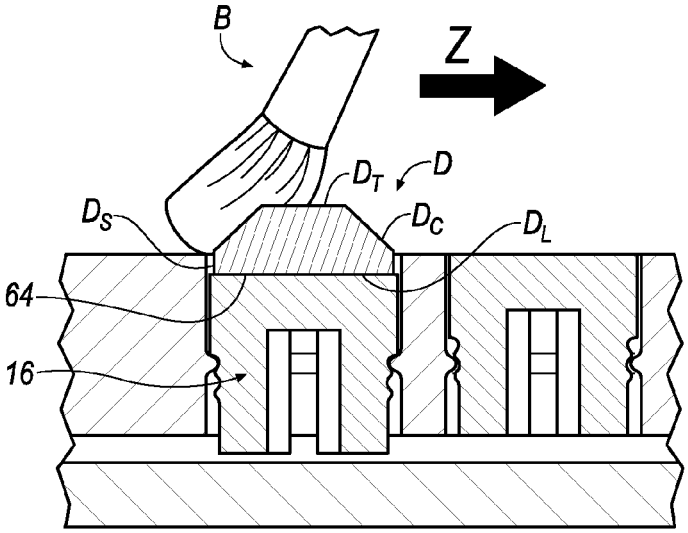
Figure 12C:
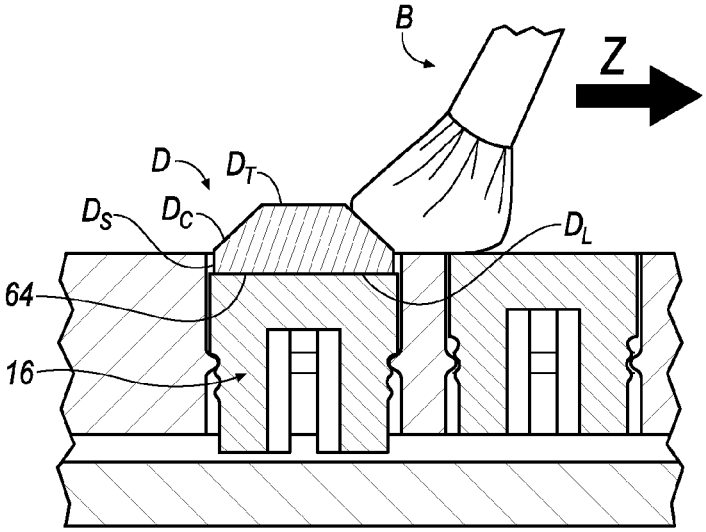

Referring now to FIGS. 12A-12C and 13A-13E, a method for utilizing the brush, B, of FIG. 10B is described. As seen in FIGS. 12A-12C, a decorative object, D, is shown to be located adjacent the upper surface 64 of a depressed pattern adjustment plunger 16 in a "right side up" position/orientation whereas in FIG. 13A, the decorative object, D, is shown to be located adjacent the upper surface 64 of a depressed pattern adjustment plunger 16 in an "upside down" position/orientation.

In an embodiment, the decorative object, D, in FIGS. 12A-13E is shown to include a top surface, $D_T$, a chamfered surface, $D_C$, a side surface, $D_S$, and a lower surface, $D_L$. In an embodiment, as seen in FIGS. 12A-12C, the lower surface, $D_L$, is placed adjacent the upper surface 64 of a depressed pattern adjustment plunger 16 (i.e., locating the decorative object, D, in a "right side up" orientation) such that the brush, B, may come into contact with the top surface, $D_T$, chamfered surface, $D_C$, and side surface, $D_S$. Conversely, as seen in FIG. 13A, the top surface, $D_T$, is initially placed adjacent the upper surface 64 of a depressed pattern adjustment plunger 16 (i.e., locating the decorative object, D, in an "upside down" orientation) such that the brush, B, may subsequently come into contact with the chamfered surface, $D_C$, and side surface, $D_S$.

As seen in FIGS. 12A-12B, when the brush, B, is moved according to the direction of the arrow, Z, the brush, B, comes into contact with and moves across the top surface, $D_T$, chamfered surface, $D_C$, and side surface, $D_S$, of the decorative object, D. As seen in FIG. 12C, when moved in the above-described manner, the decorative object, D, remains adjacent the upper surface 64 of the depressed pattern adjustment plunger 16 and in the "right side up" orientation.

Figure 13A:
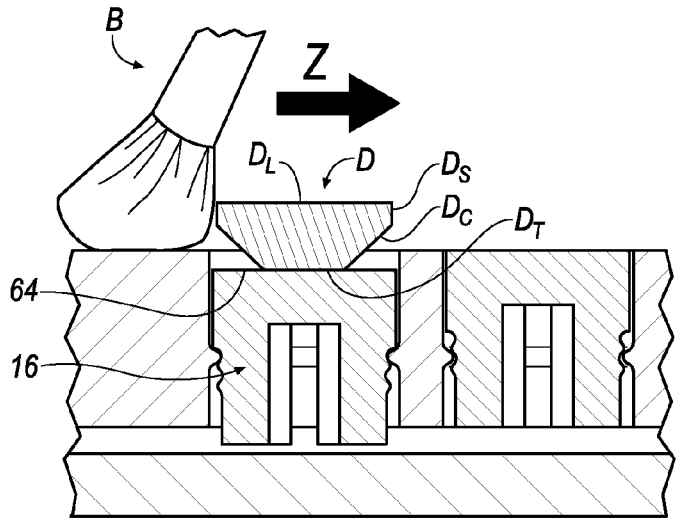
Figure 13B:
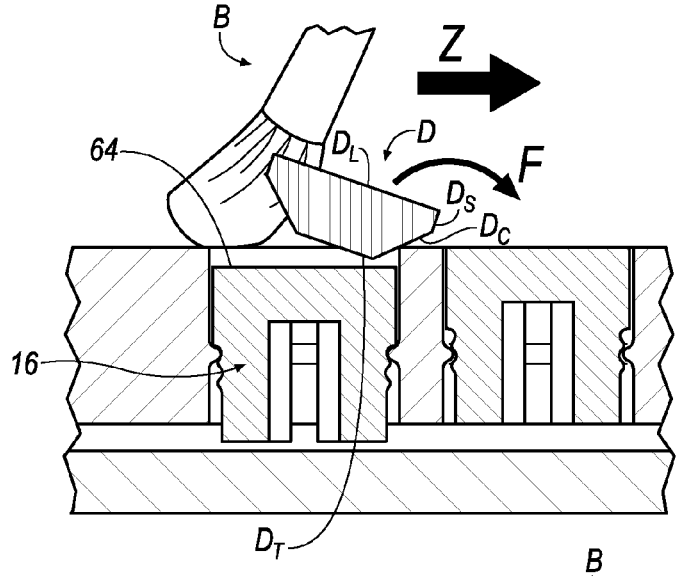
Figure 13C:
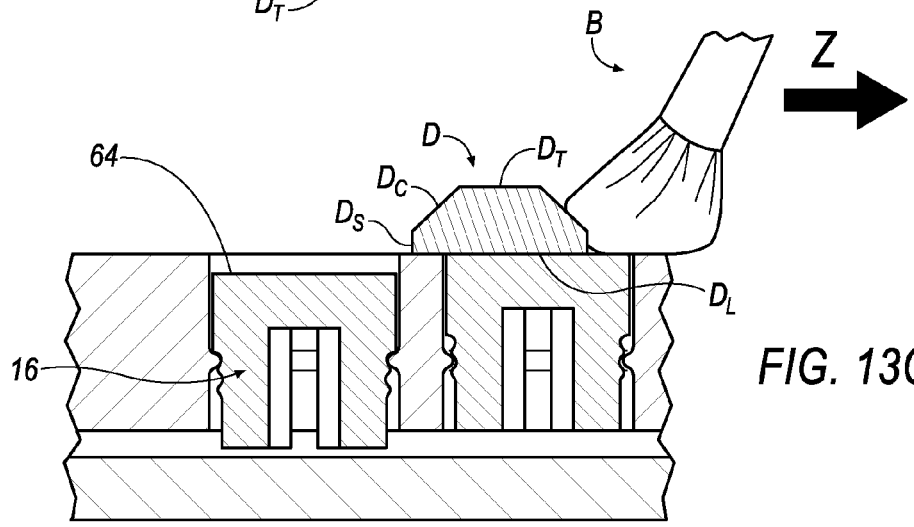

However, as seen in FIG. 13A, when the brush, B, is moved according to the direction of the arrow, Z, the brush, B, may come into contact with and moves across the chamfered surface, $D_C$, and side surface, $D_S$, of the decorative object, D, such that the bristles of the brush, B, are able to move at least partially underneath the decorative object, D, proximate the chamfered surface, $D_C$. Referring to FIG. 13B, when moved in the manner described in FIG. 13A, the decorative object, D, may be flipped over according to the direction of the arrow, F, and moved away from the upper surface 64 of the depressed pattern adjustment plunger 16 such that the orientation of the decorative object, D, is changed from an "upside down" orientation (see, e.g., FIG. 13A) to a "right side up" orientation (see, e.g., FIG. 13C) relative the tray portion 14.

Figure 13D:
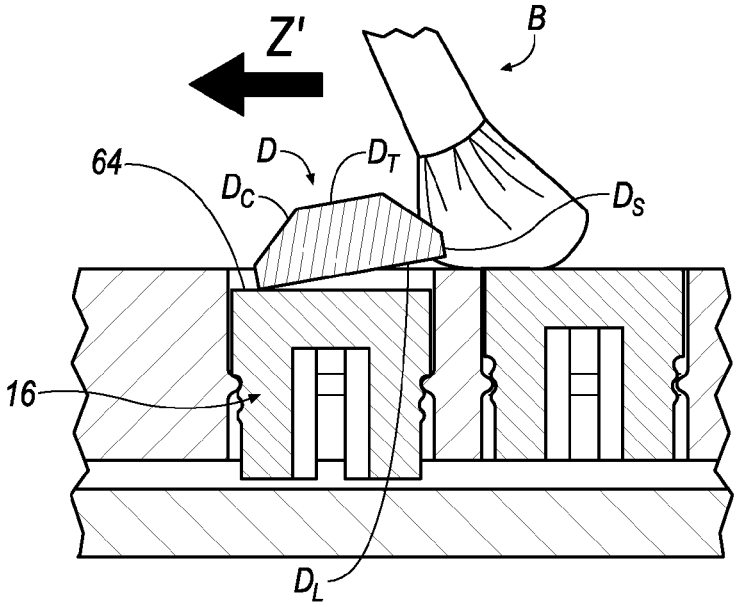
Figure 13E:
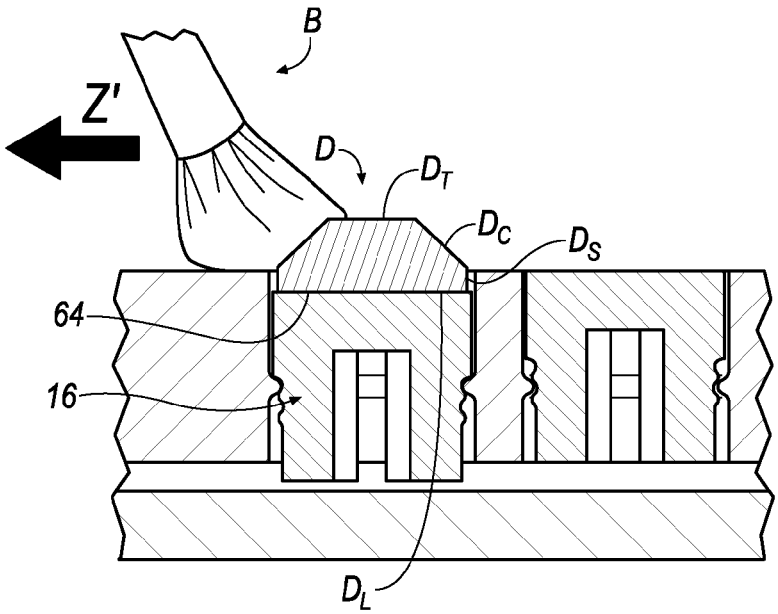

Referring to FIG. 13D, the brush, B, may then be moved according to the direction of the arrow, Z', which is substantially opposite the direction of the arrow, Z. When moved according to the direction of the arrow, Z', the bristles of the brush, B, come into contact with and moves across the top surface, $D_T$, chamfered surface, $D_C$, and side surface, $D_S$, of the decorative object, D, such that the now "right side up" decorative object, D, is moved adjacent the upper surface 64 of a previously vacated or unoccupied depressed pattern adjustment plunger 16, as seen in FIG. 13E.

Figure 14A:
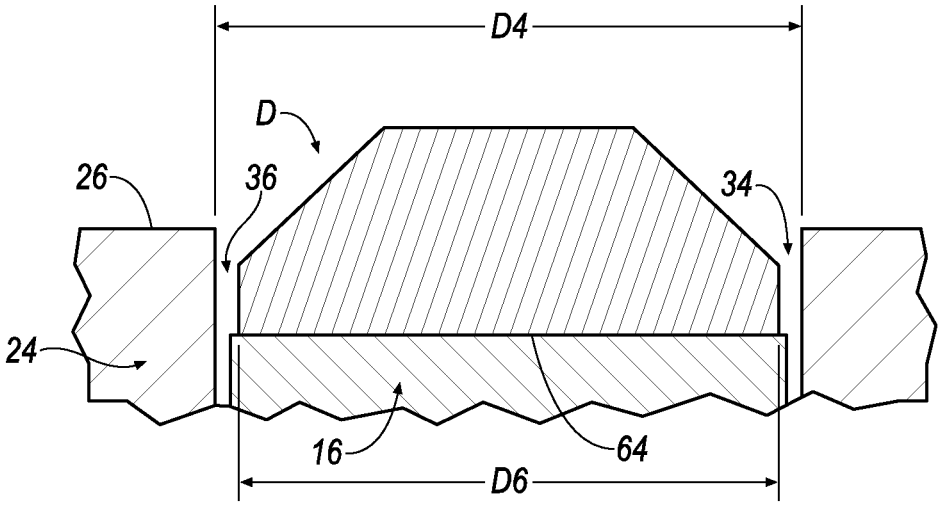
FIG. 14A illustrates a cross-sectional view of a portion of the decorative object arrangement device and a decorative object of FIG. 2A according to line 14A-14A in accordance with an exemplary embodiment of the invention.
Figure 14B:
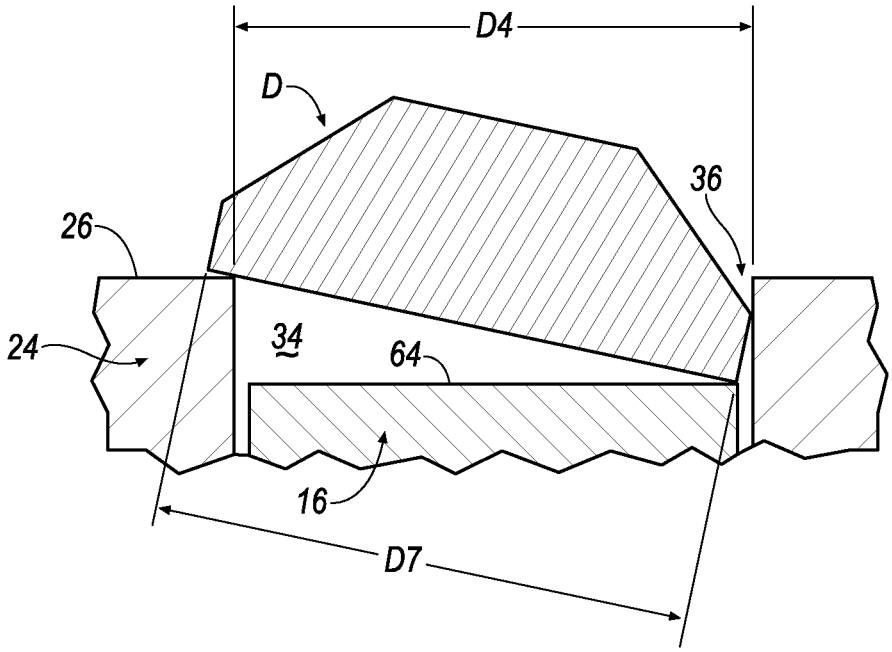
FIG. 14B is a cross-sectional view of a portion of the decorative object arrangement device and a decorative object that is greater in size when compared to the decorative object of 14A in accordance with an exemplary embodiment of the invention.

Referring to FIG. 14A, an enlarged cross-sectional view of a decorative object, D, positioned adjacent the upper surface 64 of a pattern adjustment plunger 16 is shown according to an embodiment of the invention. In an embodiment, the decorative object, D, may include a dimension/diameter, D6, that may be approximately equal to but less than the diameter, D4, of the passage 34. In an embodiment, referring to FIG. 14B, if, for example, a decorative object, D, includes a dimension/diameter, D7, that is greater than the diameter, D4, of the passage 34, it will be appreciated that the decorative object, D, may not be fully disposed adjacent the upper surface 64 of the pattern adjustment plunger 16; as such, in an embodiment, the decorative object arrangement device 10 may effectively sort larger, "defective objects" from smaller, "non-defective objects" when a plurality of decorative objects, D, are disposed upon the decorative object arrangement device 10. It will be appreciated that the sorting step performed at FIG. 14B will assist a user in utilizing substantially consistently-shaped, uniform decorative objects, D, when a plurality of decorative objects, D, are disposed upon the decorative object arrangement device 10 as seen in FIG. 9.

Figure 15A:
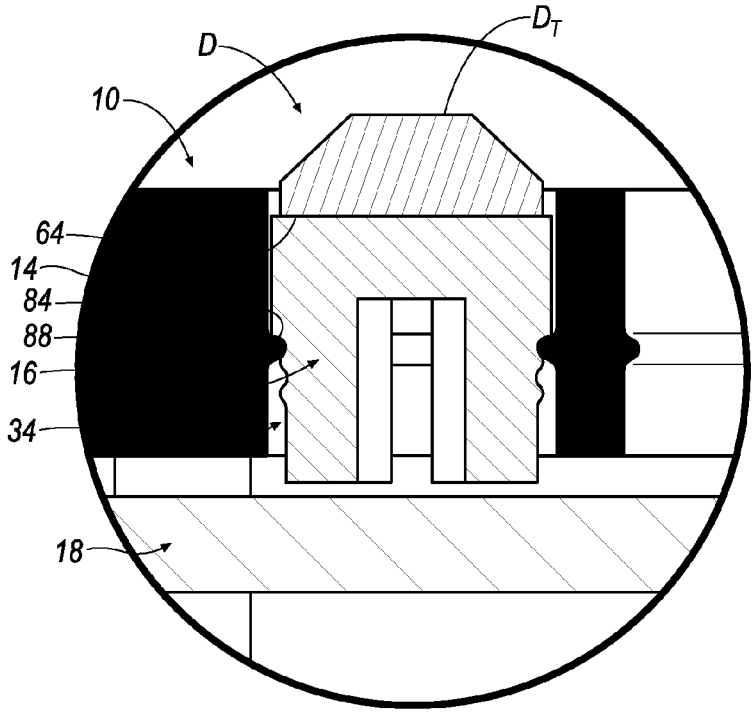
FIGS. 15A-17 illustrate a method for removing the predetermined pattern of decorative objects from the decorative object arrangement device in accordance with an exemplary embodiment of the invention.
Figure 15B:
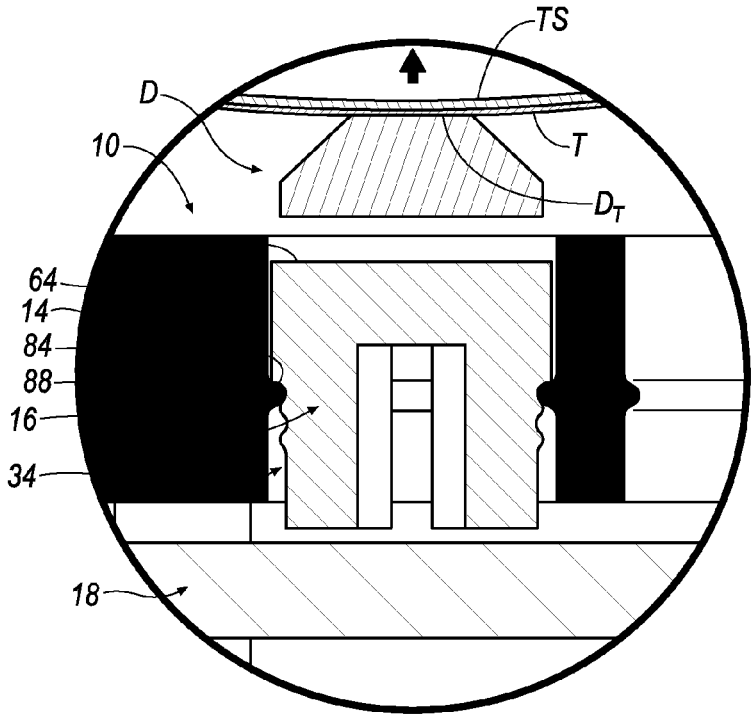
Figure 16:
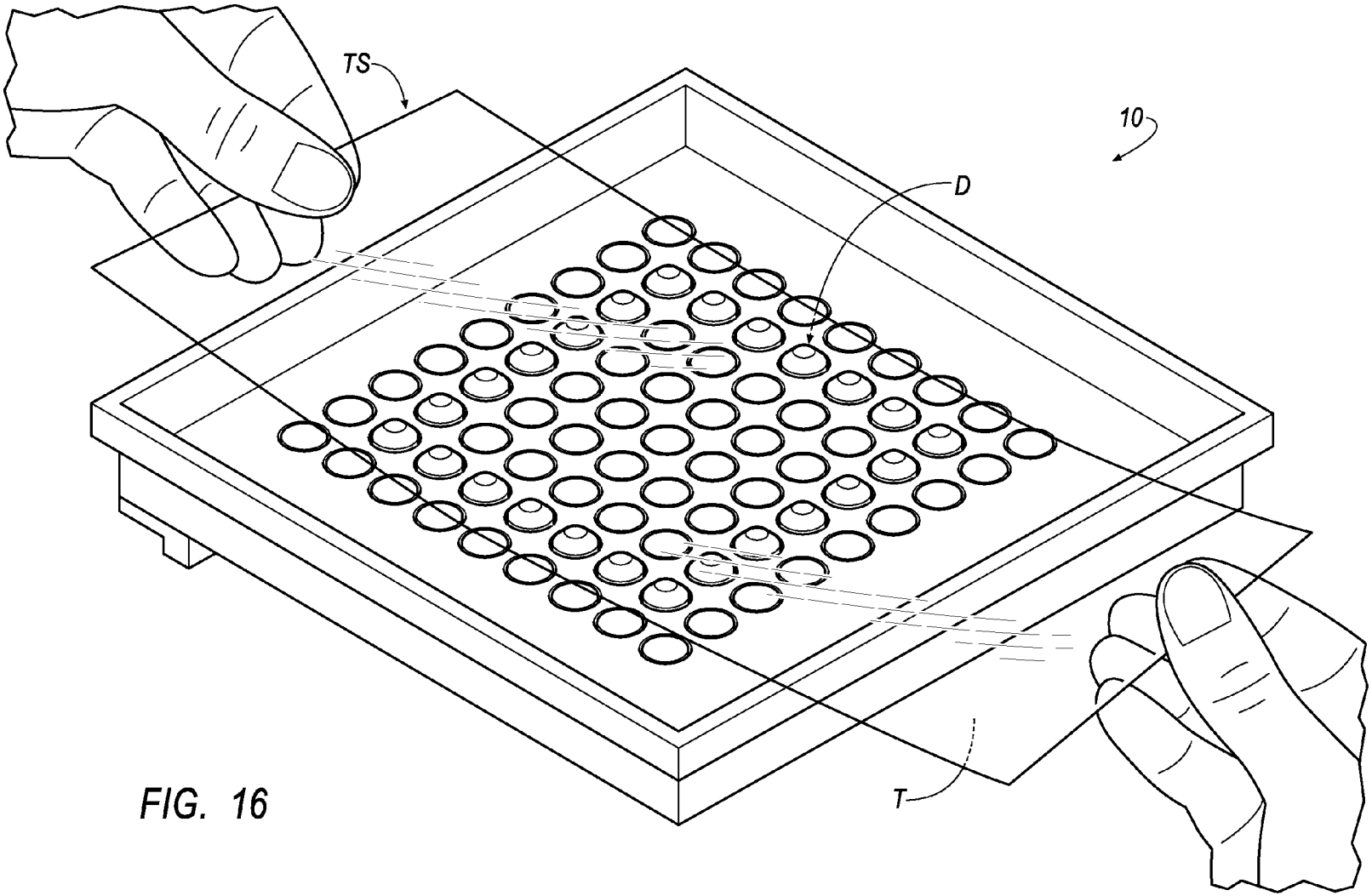

Referring now to FIGS. 15A and 16, a plurality of decorative objects, D, are shown positioned adjacent the upper surface 64 of a plurality of depressed pattern adjustment plungers 16. In an embodiment, the top surface, $D_T$, of each decorative object, D, is arranged outside of and away from the passage 34 in order to permit a removal device (e.g., a transfer sheet, TS, of FIGS. 15B, 16) to contact the top surface, $D_T$. It will be appreciated, however, that the top surface, $D_T$, of the decorative object, D, may be arranged completely within the passage 34, but, however, it will be appreciated that it may be difficult for a removal device, TS, to easily gain access to the decorative object, D, when the top surface, $D_T$, of the decorative object, D, is arranged completely within the passage 34; as such, it will be appreciated that the design of the passage 34 of the tray portion 14 and the pattern adjustment plunger 16 may limit an axial depression of the pattern adjustment plunger 16 within the passage 34 in an orientation that may result in the prevention of the top surface, $D_T$, of the decorative object, D, from being disposed completely within the passage 34. In an embodiment, this limitation of the axial depression of the pattern adjustment plunger 16 may be provided by the shoulder surface 84 of the pattern adjustment plunger 16 being brought into direct engagement with the substantially annular, radially-inwardly projecting ledge 88.

Figure 17:
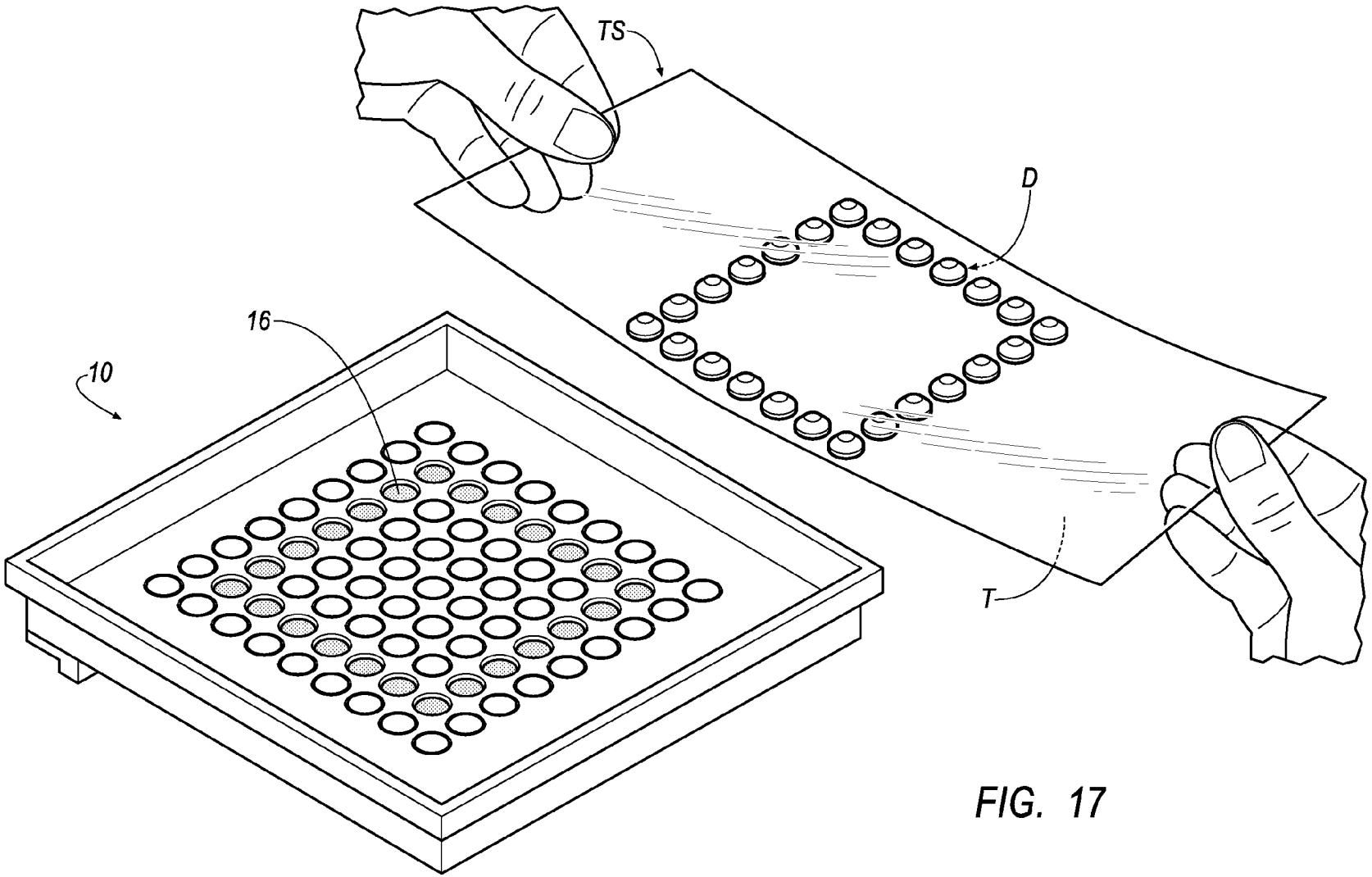

As seen in FIGS. 15B and 16, once the plurality of decorative objects, D, are arranged in a predetermined pattern as described above at FIG. 11, a user may obtain a transfer sheet, TS, including a tacky surface, T, in order to remove the plurality of decorative objects, D, from the decorative object arrangement device 10 (see, e.g., FIG. 17). As seen in FIG. 15B, for example, the tacky surface, T, is disposed adjacent the top surface, $D_T$, of the decorative object, D, in order to cause the decorative object, D, to be releasably-adhered to the transfer sheet, TS, for subsequent removal as described above.

Figure 18:
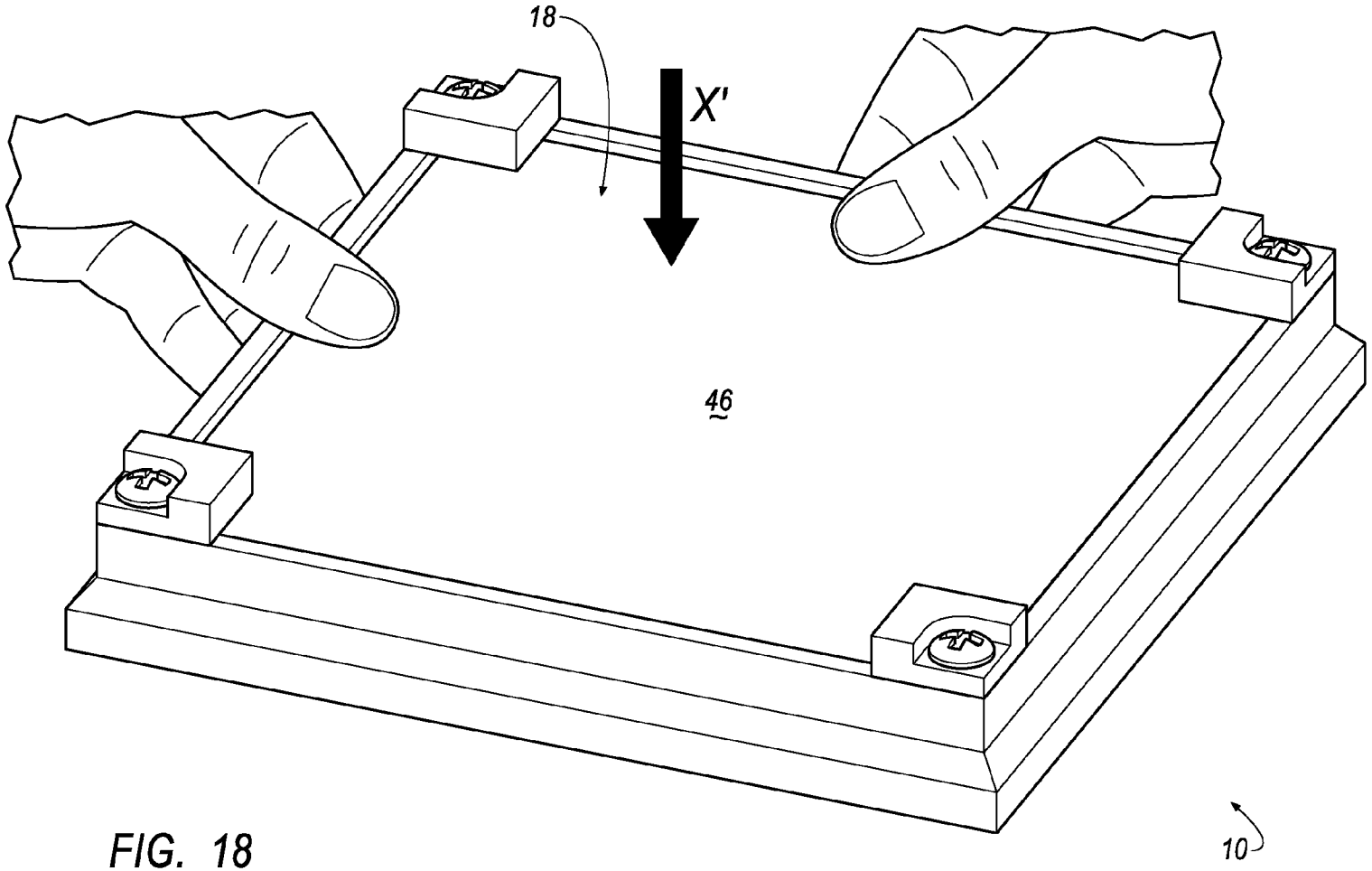
Figure 19A:
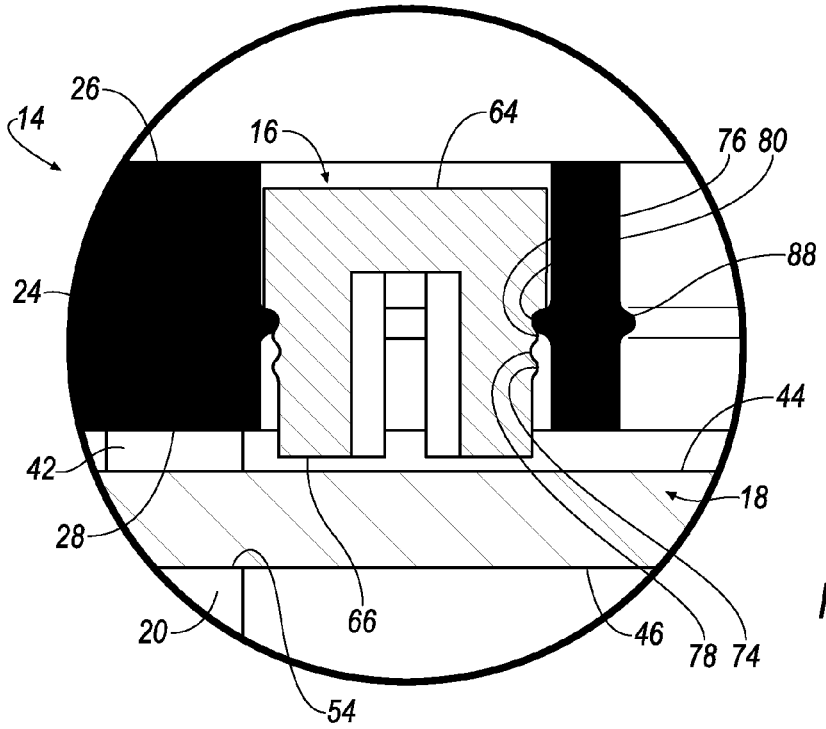
Figures 20A, 20B:
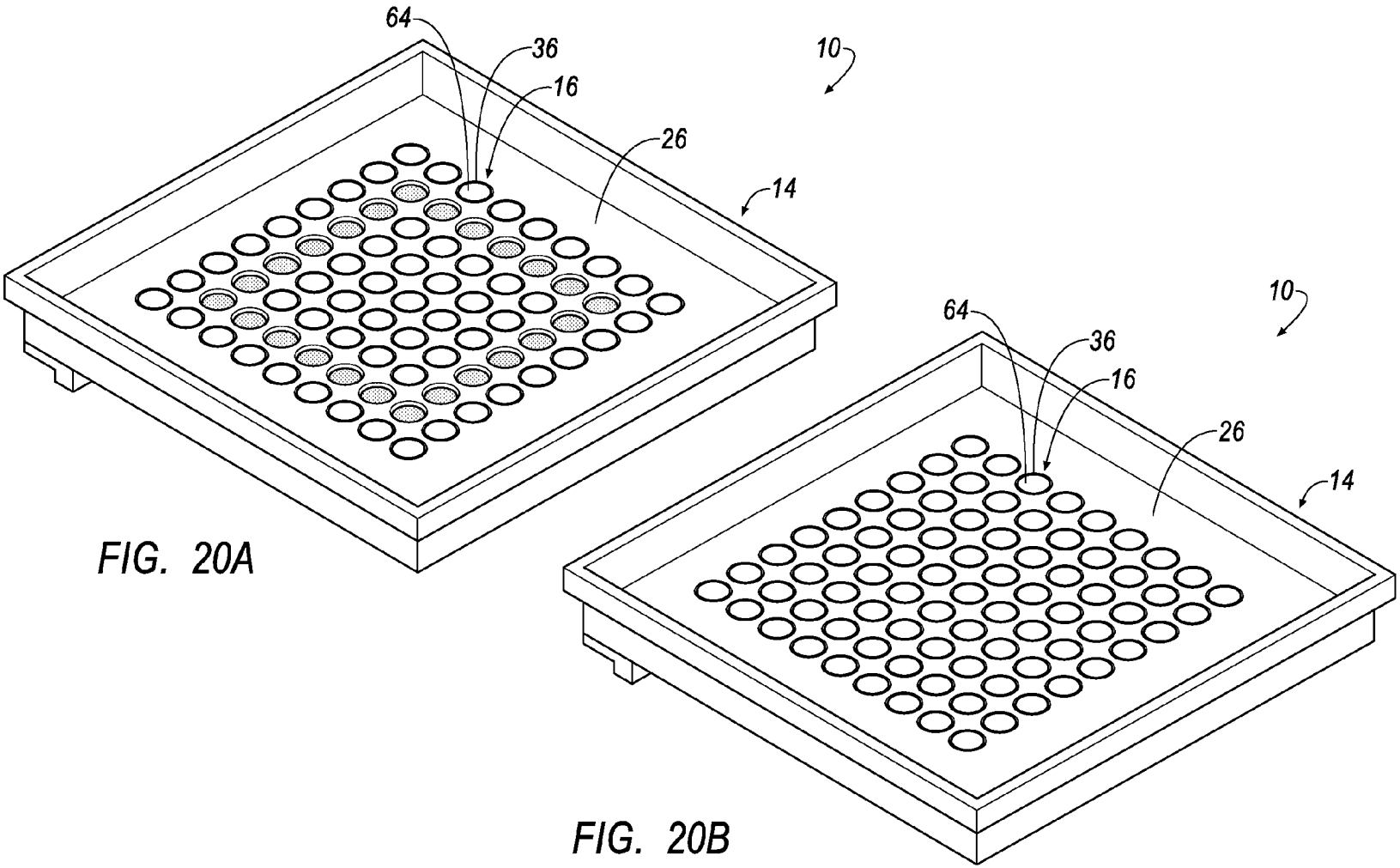

Referring now to FIG. 18, once the plurality of decorative objects, D, have been removed from the decorative object arrangement device 10, the user may wish to "reset" the plurality of depressed pattern adjustment plungers 16 from their depressed state (see, e.g., FIGS. 6B and 20A) to their pre-depressed state (see, e.g., FIGS. 6A and 20B). In an embodiment, as seen in FIGS. 18 and 19A, the resetting of the plurality of depressed pattern adjustment plungers 16 to their pre-depressed state may be accomplished by applying a force to the lower surface 46 of the plunger reset plate 18 according to the direction of the arrow, X'.

Figure 19B:
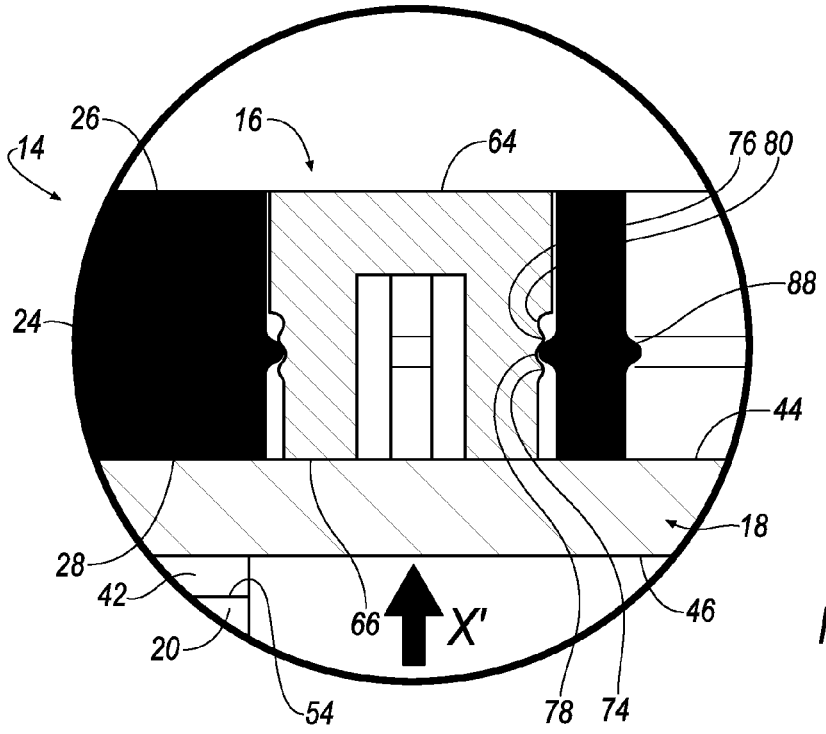

Referring to FIGS. 19A and 19B, upon applying a force according to the direction of the arrow, X', the upper surface 44 of the plunger reset plate 18 engages the rear surface 66 of the depressed pattern adjustment plunger 16. The force applied to the plunger reset plate 18 causes the depressed pattern adjustment plunger 16 to be axially moved according to the direction of the arrow, X', until the upper surface 44 of the plunger reset plate 18 engages the lower surface 28 of the body 24 of the tray portion 14.

Figure 19C:
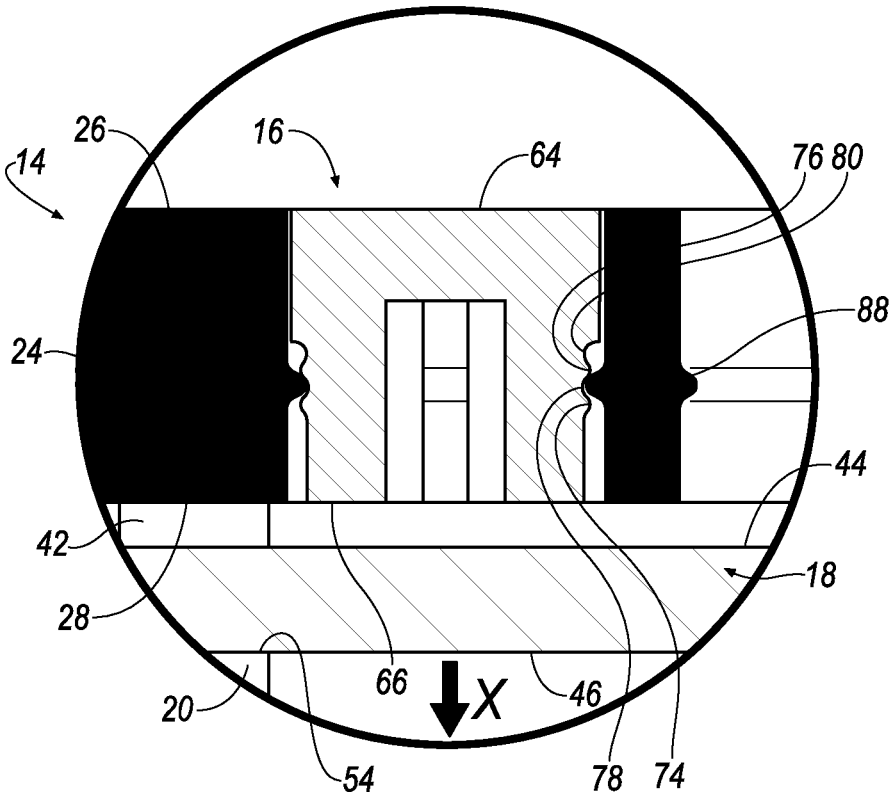

Referring to FIG. 19B, in an embodiment, once the upper surface 44 of the plunger reset plate 18 engages the lower surface 28 of the body 24 of the tray portion 14, the upper surface 64 of each of the depressed pattern adjustment plungers 16 are returned to their coplanar relationship with the upper surface 26 of the body 24 of the tray portion 14. Further, in an embodiment, the axial movement of the depressed pattern adjustment plunger 16 according to the direction of the arrow, X', causes the substantially annular, radially-inwardly projecting ledge 88 to become unseated from the second valley 80, such that the second peak 76 of the depressed pattern adjustment plunger 16 rides over the substantially annular, radially-inwardly projecting ledge 88, which results in the substantially annular, radially-inwardly projecting ledge 88 being seated within the first valley 78. Referring to FIG. 19C, once the user has released the force applied to the plunger reset plate 18 according to the direction of the arrow, X', the plunger reset plate 18 may fall, with the assistance of gravity, according to the direction of the arrow, X, to an orientation such that the lower surface 46 of the reset plunger plate 18 comes into contact with the second portion 54 of the upper surface 50 of each of the reset plate retaining members 20.

Figure 21A:
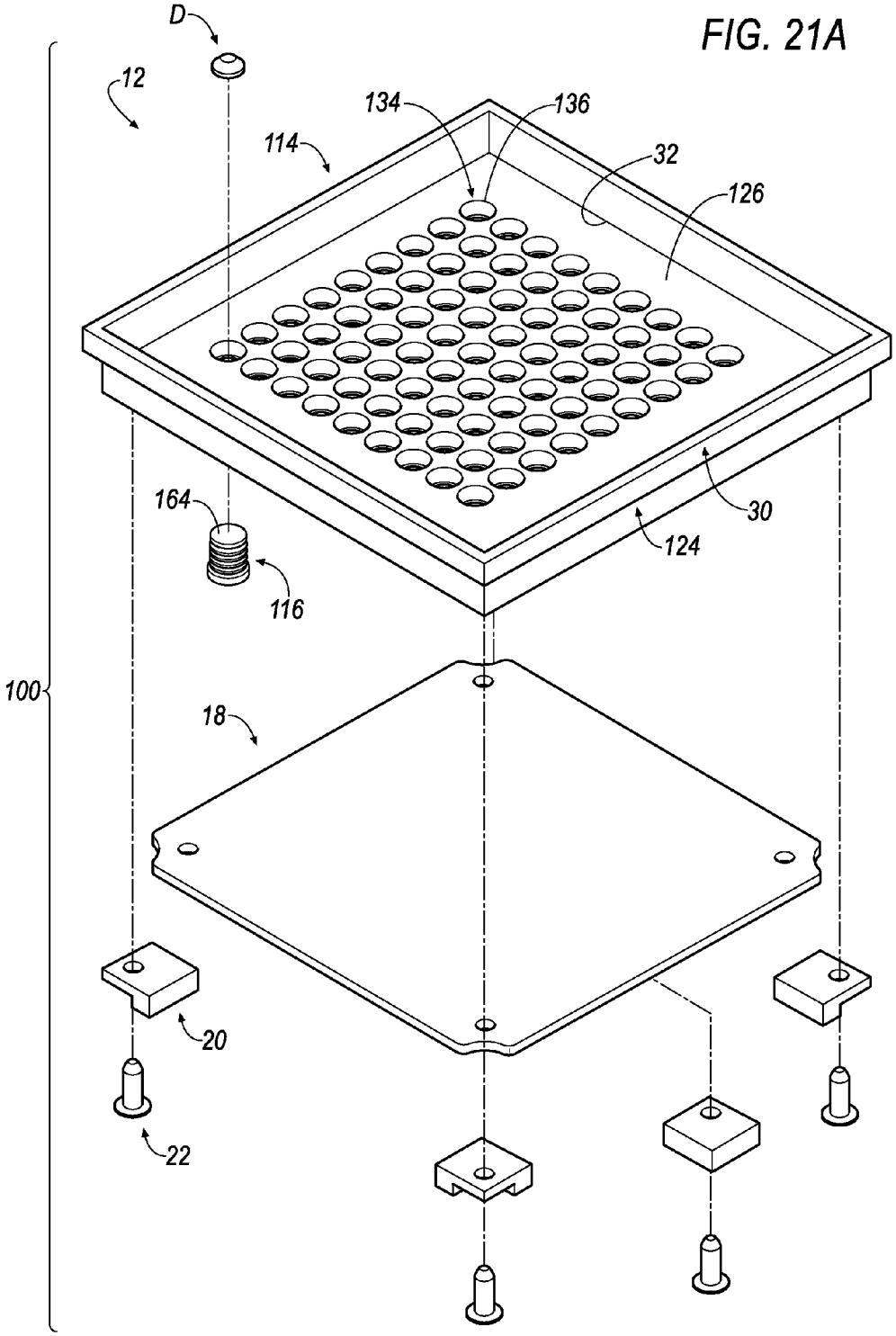
FIG. 21A is a top exploded view of a decorative object arrangement device in accordance with an exemplary embodiment of the invention.
Figure 21B:
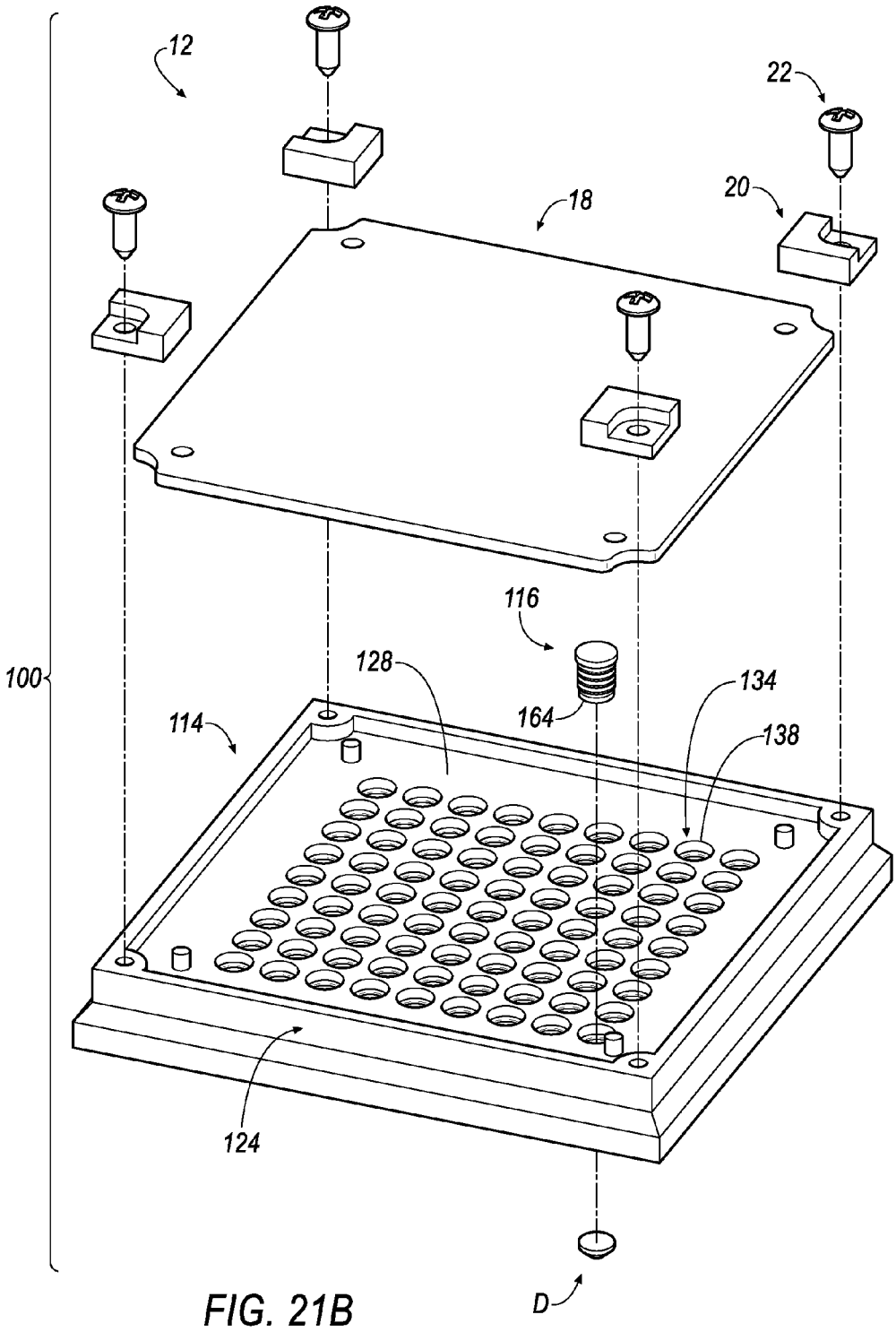
FIG. 21B is a bottom exploded view of the decorative object arrangement device of FIG. 21A in accordance with an exemplary embodiment of the invention.

Referring to FIGS. 21A-21B, a decorative object arrangement device is shown generally at 100 in accordance with an exemplary embodiment of the invention. In an embodiment, the decorative object arrangement device 100 is substantially similar in operation and structure as that of the decorative object arrangement device 10 with the exception of the design of an alternative pattern adjustment plunger, which is shown generally at 116, and the passage, which is shown at 134. Further, the method of assembling the decorative object arrangement device 100 is different than that of the decorative object arrangement device 10 in that rather than inserting the pattern adjustment plunger 116 into a passage 34 by way of the upper opening 36, the pattern adjustment plunger 116 is inserted into a passage 134 by way of a lower opening 138.

Figure 22A:
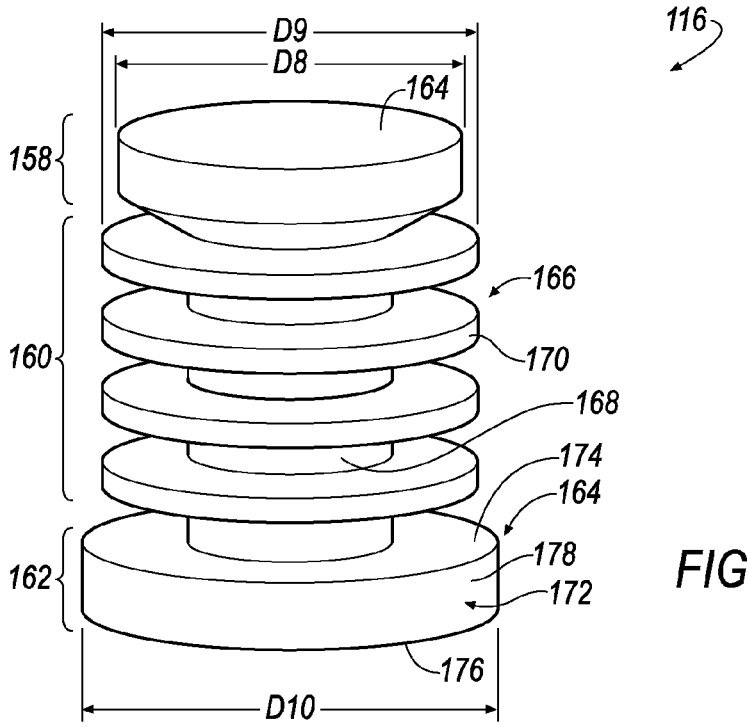
FIG. 22A is a top perspective view of a pattern adjustment plunger of the decorative object arrangement device of FIGS. 21A-21B in accordance with an exemplary embodiment of the invention.
Figure 22B:
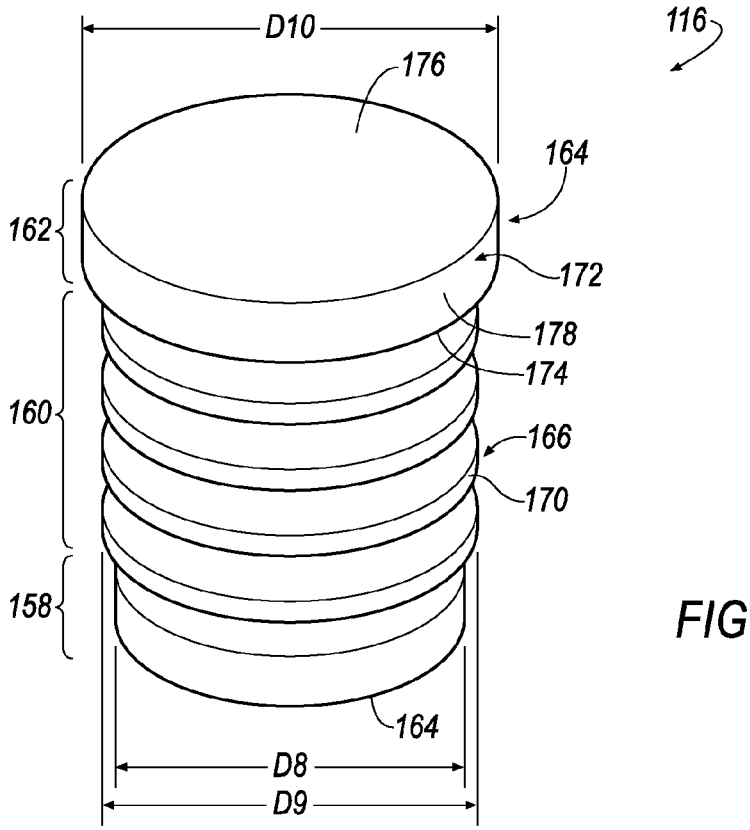
FIG. 22B is a bottom perspective view of a pattern adjustment plunger of the decorative object arrangement device of FIGS. 21A-21B in accordance with an exemplary embodiment of the invention.

Referring to FIGS. 22A-22B, an enlarged view of the pattern adjustment plunger 116 is shown according to an embodiment of the invention. In an embodiment, the pattern adjustment plunger 116 includes a substantially cylindrical shape having a head portion 158 joined to a shoulder portion 160 and a neck portion 162 joined to the shoulder portion 160.

In an embodiment, the head portion 158 generally includes an annular-shaped disk having an outer diameter, D8. In an embodiment, the head portion 158 defines the upper surface 164 of the pattern adjustment plunger 116.

In an embodiment, the shoulder portion 160 includes a plurality of spaced, annular-shaped disks 166 connected by a spine 168. In an embodiment, each disk of the plurality of spaced, annular-shaped disks 166 includes an outer side surface 170 defining an outer diameter, D9.

In an embodiment, the neck portion 162 generally includes an annular-shaped disk 172 having an upper surface 174, a lower surface 176 and an outer side surface 178. In an embodiment, the outer side surface 178 defines an outer diameter, D10.

In an embodiment, the diameter, D10, of the neck portion 162 is greater than the diameter, D9, of the shoulder portion 160. In an embodiment, the diameter, D9, of the shoulder portion 160 is greater than the diameter, D8, of the head portion 158.

Figure 23A:
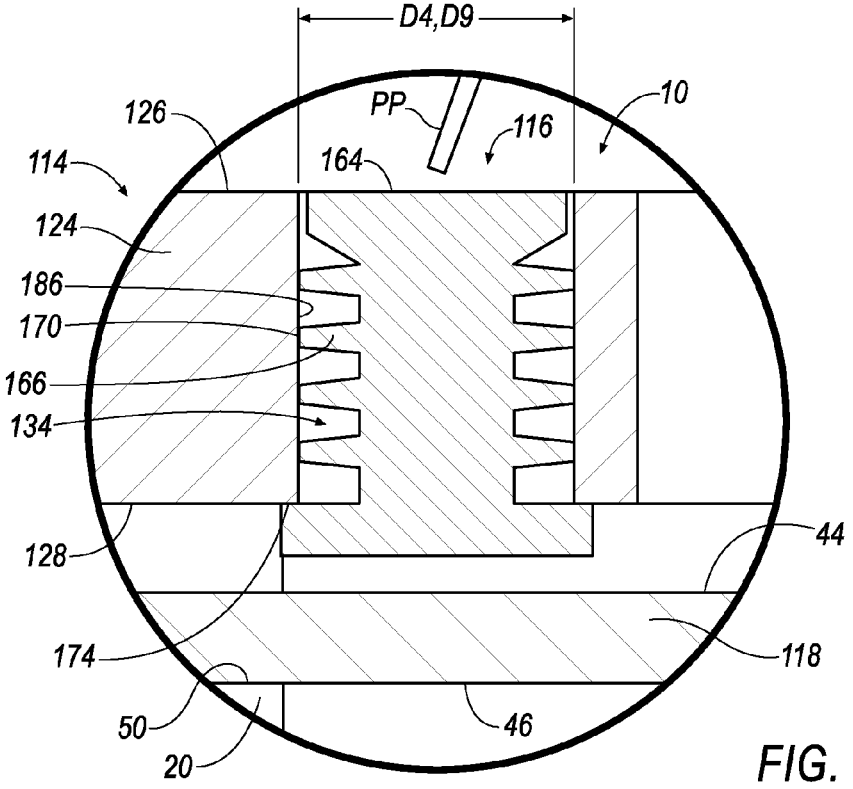
FIGS. 23A-23F illustrate a plurality of enlarged cross-sectional views of the pattern adjustment plunger and decorative object arrangement device according to FIGS. 21A-21B in accordance with an exemplary embodiment of the invention.

Referring now to FIG. 23A, an enlarged view of the pattern adjustment plunger 116 disposed within a passage 134 of a tray portion 114 is shown according to an embodiment. Initially, in FIG. 23A, the pattern adjustment plunger 116 is shown in a non-depressed state such that an upper surface 164 of the pattern adjustment plunger 116 is substantially coplanar with an upper surface 126 of the body 124 of the tray portion 114. When in the non-depressed state, the upper surface 174 of the neck portion 162 is disposed substantially adjacent the lower surface 128 of the body 124 of the tray portion 114.

In an embodiment, the outer side surface 170 of each disk of the plurality of spaced, annular-shaped disks 166 of the shoulder portion 160 is disposed adjacent a wall surface 186 of the passage 134. In an embodiment, the diameter, D9, of the shoulder portion 160 is approximately the same as the opening diameter, D4, of the passage 134.

Figure 23B:
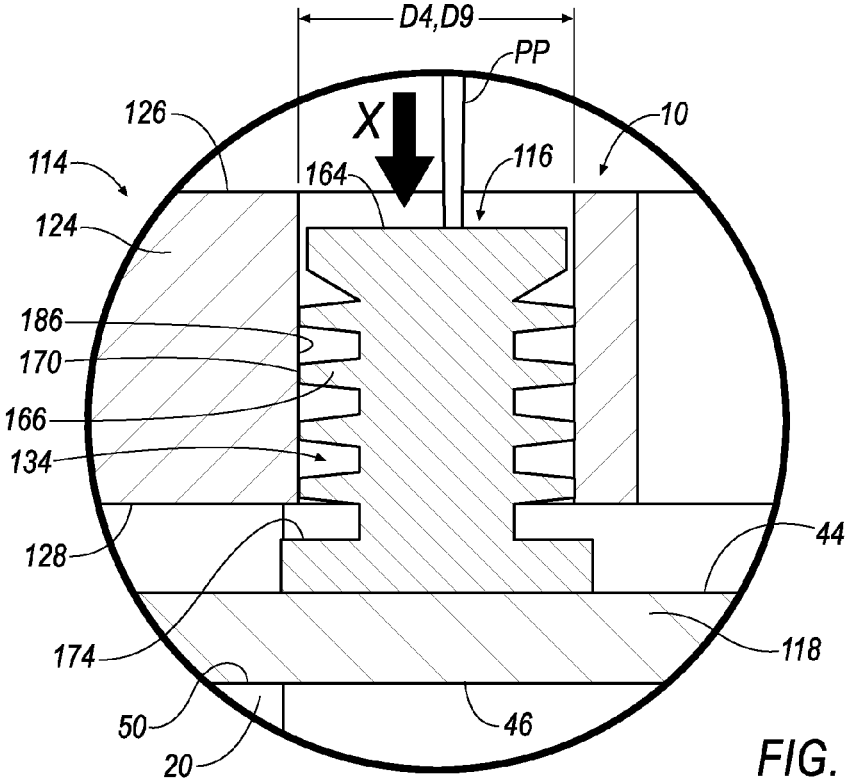
Figure 23C:
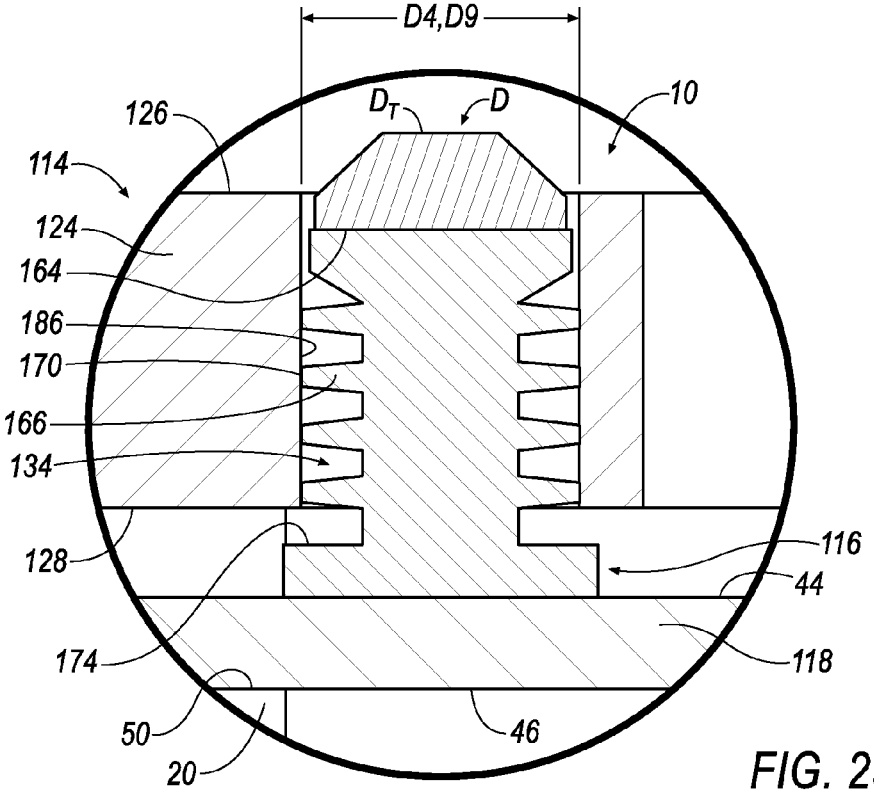
Figure 23D:
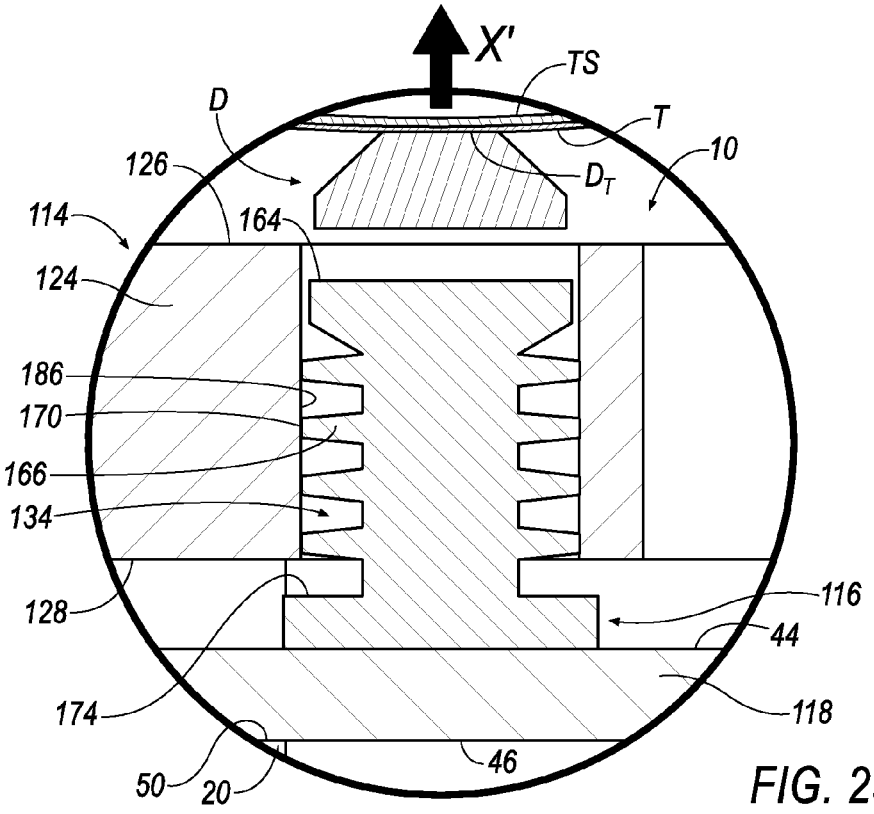
Figure 23E:
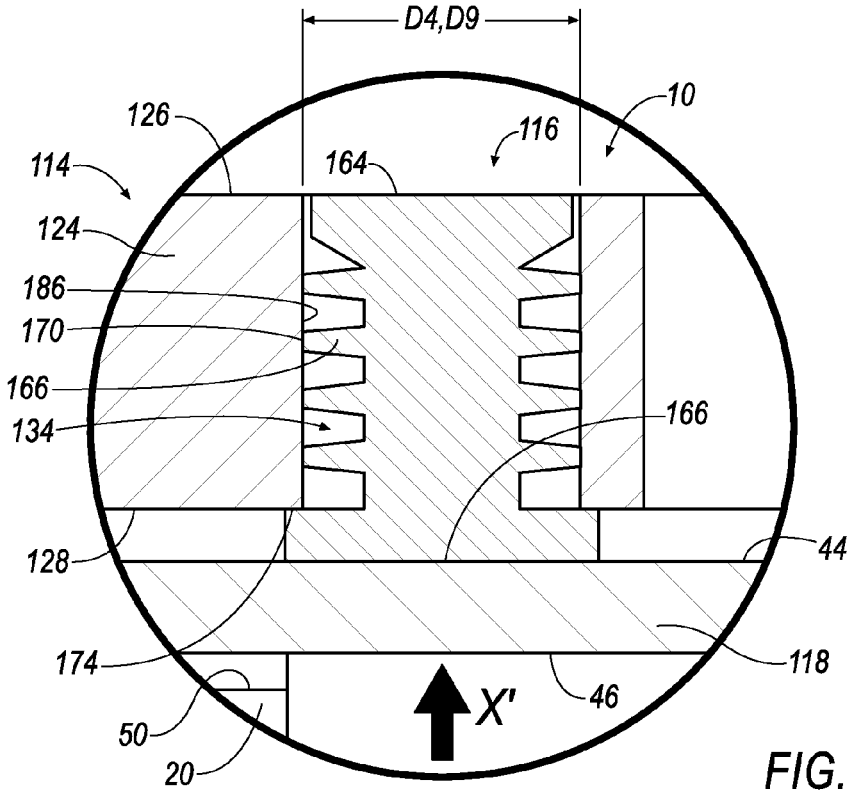
Figure 23F:
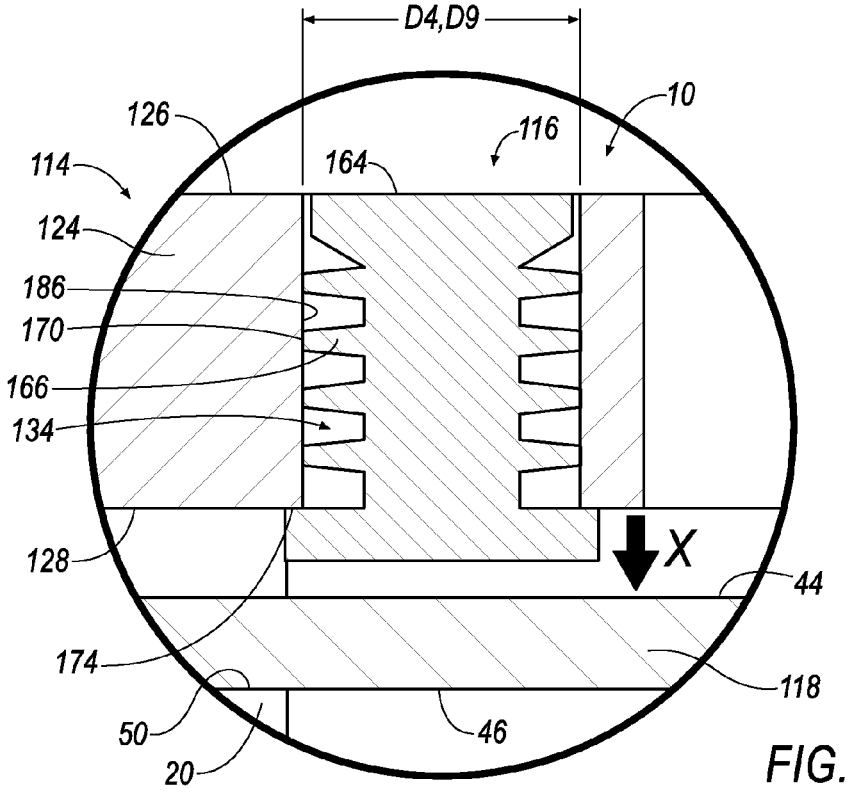
Figure 24:
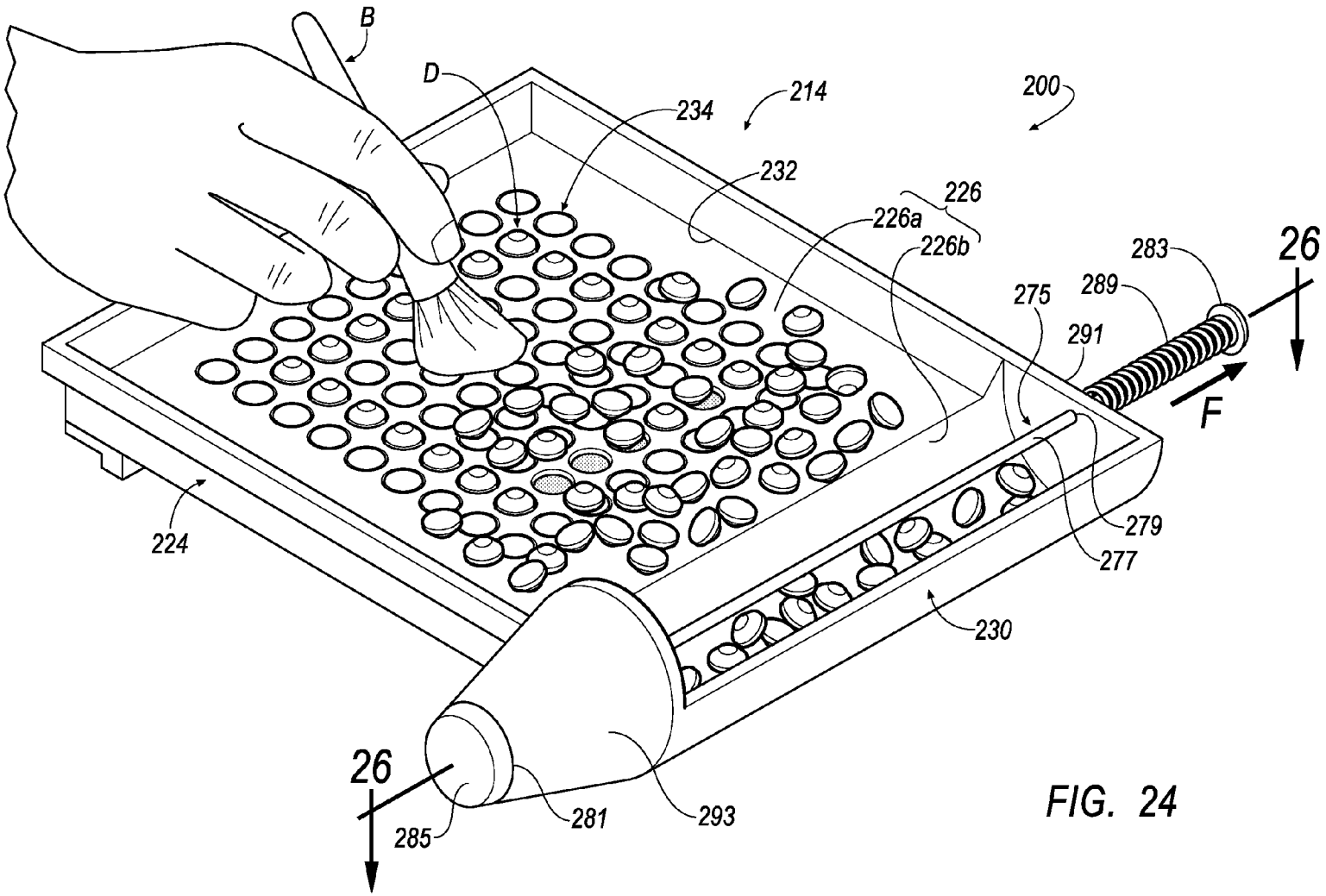
FIG. 24 is a top, assembled perspective view of a decorative object arrangement device showing a user upsetting the orientation of the plurality of decorative objects in accordance with an exemplary embodiment of the invention.
Figure 25:
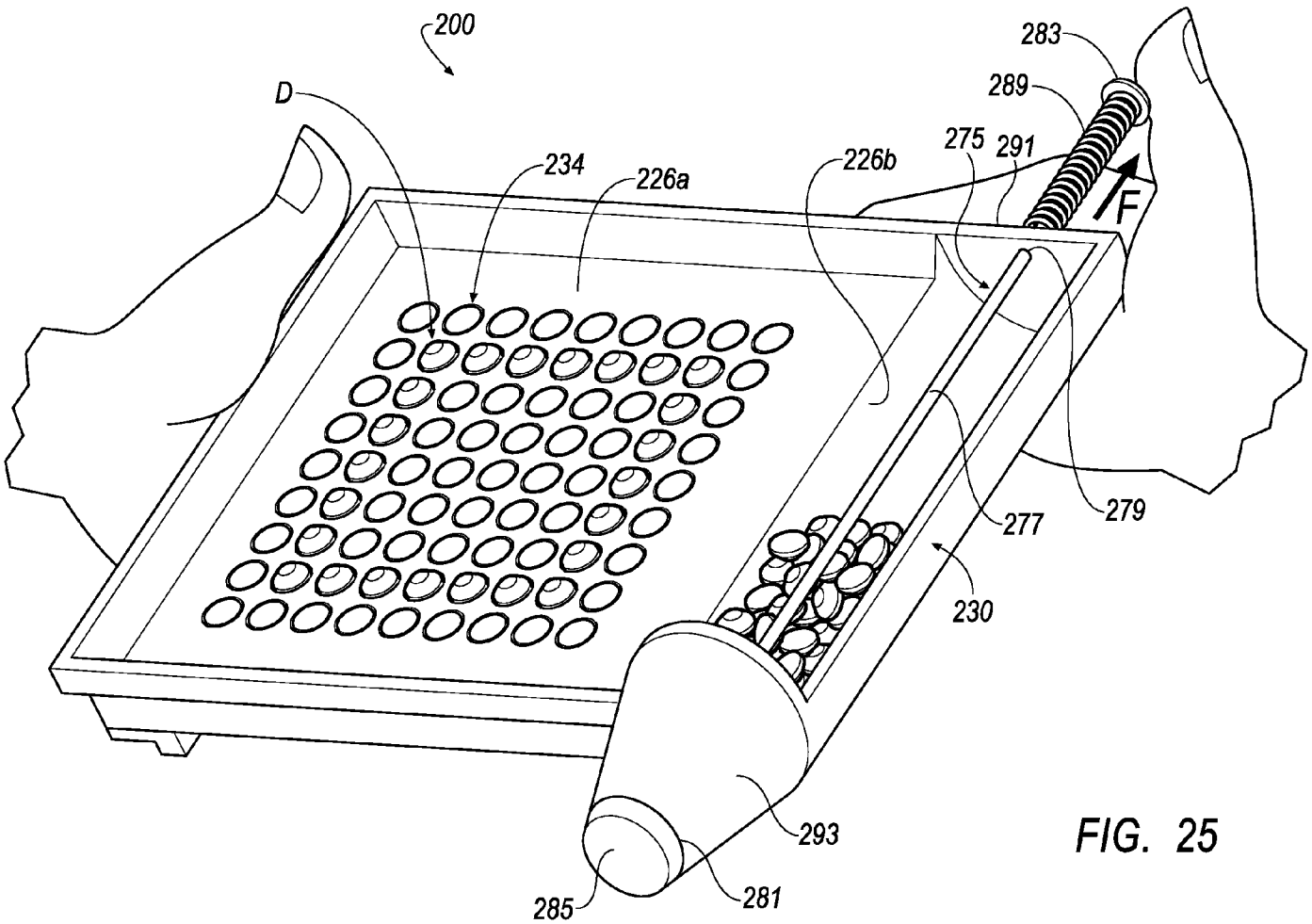
FIG. 25 is a top, assembled perspective view of the decorative object arrangement device of FIG. 24 showing some of the plurality of decorative objects arranged in a predetermined pattern in accordance with an exemplary embodiment of the invention.

Because the diameters, D4, D9, are substantially the same, the adjacency of the outer side surface 170 with the wall surface 186 constitutes a friction-fit relationship of the pattern adjustment plunger 116 within the passage 134 of the body 124 of the tray portion 114. Accordingly, when the axial orientation of the pattern adjustment plunger 116 is adjusted to/from a non-depressed state (see, e.g., FIGS. 23A, 23E, 23F) and a depressed state (see, e.g., FIGS. 23B-23D), the adjusted axial orientation of the pattern adjustment plunger 116 relative the passage 134 may be retained without the utilization of a substantially annular, radially-inwardly projecting ledge 88 formed on the wall surface 86 that cooperates with first and second tactile-feedback portions 82*a*, 82*b* as described with respect to the pattern adjustment plunger 16 and decorative object arrangement device 10.

Although the passage 134 of the tray portion 114 does not include the substantially annular, radially-inwardly projecting ledge 88, and, the pattern adjustment plunger 116 does not include a shoulder surface 84 for limiting an amount of axial depression of the pattern adjustment plunger 116, it will be appreciated that the upper surface 44 of the plunger reset plate 118 limits the amount of travel of the pattern adjustment plunger 116. As such, when the pattern adjustment plunger 116 engages the plunger reset plate 118, the decorative objects, D, placed upon the upper surface 164 of each pattern adjustment plunger 116 may be accessible by a removal device, TS (see, e.g., FIG. 23D), as described above.

Referring to FIGS. 24-26B, a decorative object arrangement device is shown generally at 200 in accordance with an exemplary embodiment of the invention. In an embodiment, the decorative object arrangement device 200 is substantially similar in operation and structure as that of the decorative object arrangement device 10, 100 with the exception of the design of an upper surface 226 of a body 224 of the tray portion 214 and a selectively-manipulatable lip assembly 275 connected to the lip portion 230. In an embodiment, passages 234 of the tray portion 214 may include one of or both of the designs corresponding to either of the pattern adjustment plungers 16, 116.

In an embodiment, the upper surface 226 of the body 224 includes a substantially planar portion 226*a* that is similar in design to the upper surfaces 26, 126. In an embodiment, the upper surface 226 of the body 224 also includes a substantially arcuate-shaped valley portion 226*b* that is connected to the substantially planar portion 226*a*. In an embodiment, the substantially arcuate-shaped valley portion 226*b* functionally acts as a trough that receives decorative objects, D, that were not included in the predetermined pattern according to the depressed pattern adjustment plungers 16, 116.

In an embodiment, the selectively-manipulatable lip assembly 275 is connected to the lip portion 230 and is aligned with the substantially arcuate-shaped valley portion 226*b*. In an embodiment, the selectively-manipulatable lip assembly 275 includes a push rod 277 that extends through a first passages 279 formed in the lip portion 230 and a second passage 281 formed in the lip portion 230.

Figure 26A:
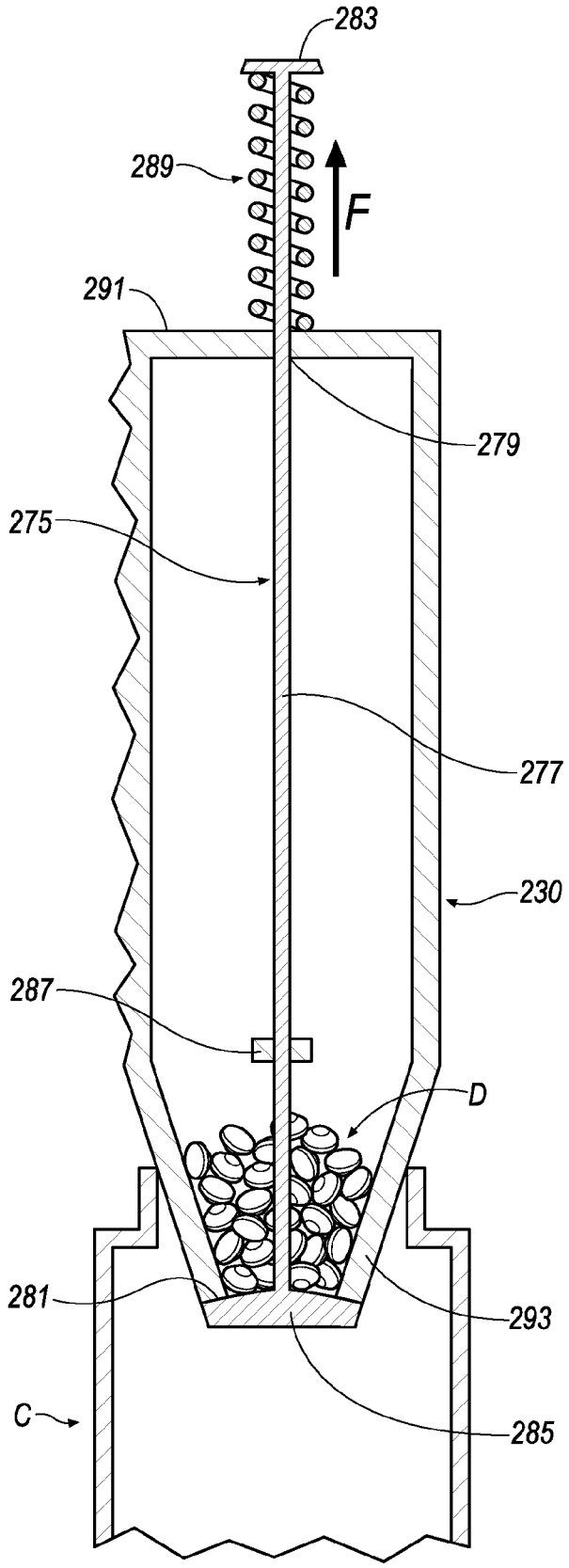
FIGS. 26A-26B illustrate a cross-sectional view of the decorative object arrangement device of FIGS. 24-25 showing a method for evacuating a portion of the plurality of decorative objects that were not included in the predetermined pattern in accordance with an exemplary embodiment of the invention.
Figure 26B:
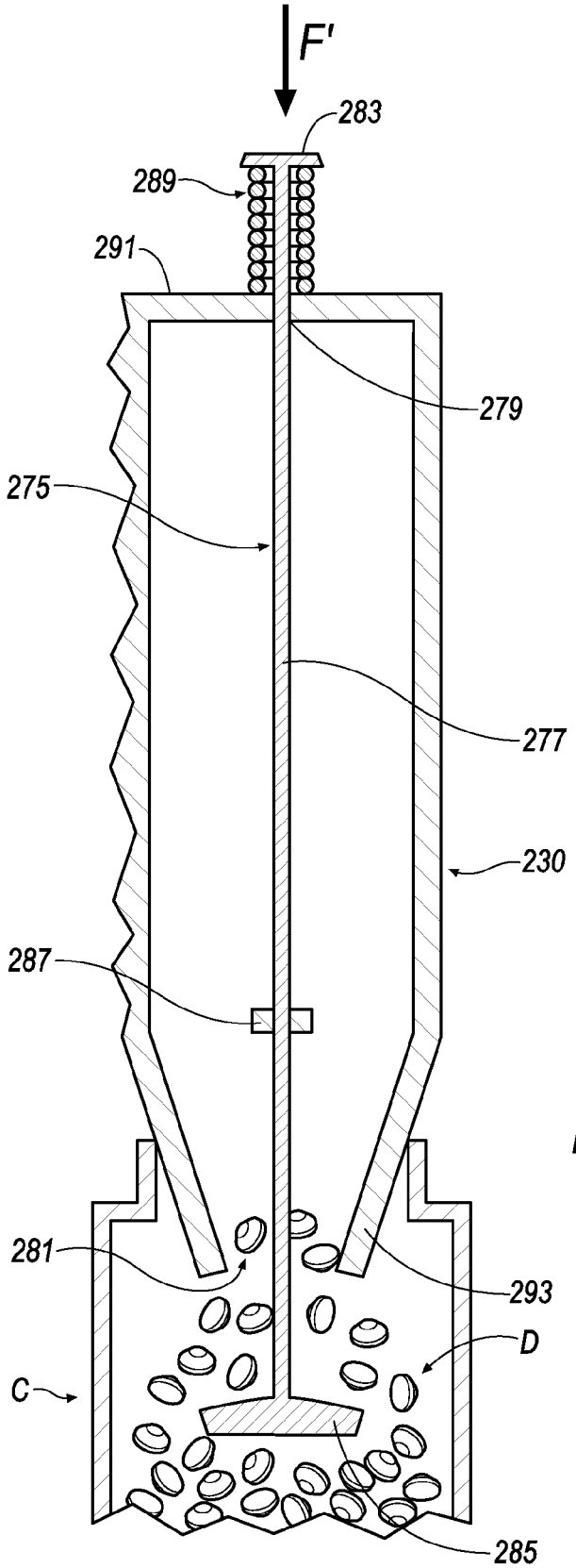

In an embodiment, a button portion 283 may be connected to a first end of the push rod 277. In an embodiment, a close-out member 285 may be connected to a second end of the push rod 277. As seen in FIGS. 26A-26B, the lip portion 230 may further comprise a support portion 287 that supports an intermediate portion of the push rod 277.

In an embodiment, the selectively-manipulatable lip assembly 275 may further comprise a spring member 289 that circumscribes a portion of the first end of the push rod 277. In an embodiment, the spring member 289 is disposed between the button portion 283 and an outer surface 291 of the lip portion 230.

In an embodiment, the spring 289 exerts a force against the button portion 283 according to the direction of the arrow, F, such that the push rod 277 is pulled in a similar direction according to the arrow, F, which results in the close-out member 285 being pulled against and sealing off the passage 281 formed in the lip portion 230. Referring to FIG. 26B, a user may apply a force to the button portion 283 in a direction according to the arrow, F', such that the bias provided by the spring 289 is overcome, which results in movement of the push rod 277 according to the direction of the arrow, F'. As the push rod 277 is moved according to the direction of the arrow, F', the close-out member 285 is moved away from the passage 281 of the lip portion 230.

In an embodiment, as seen in FIG. 26B, a user may locate a canister, C, proximate a funnel 293 that defines the passage 281 of the lip portion 230 just prior to or during the application of the force according to the direction of the arrow, F'. In an embodiment, the passage 281 is formed in an end of the funnel 293.

When the canister, C, is position at least proximate the funnel 293 and when the force is applied according to the direction of the arrow, F', the user may tilt the decorative object arrangement device 200 in a manner to cause the decorative objects located within the substantially arcuate-shaped valley portion 226*b* to be evacuated (with the assistance of gravity) through the passage 281 formed by the funnel 293 and into the canister, C. Thus, it will be appreciated that the design of the decorative object arrangement device 200 assists a user in easily removing unpaired decorative objects, D, from the decorative object arrangement device 200 that were not included in the predetermined pattern in a simple, one-step operation rather than retrieving/scooping, R, one or more decorative objects, D, that were pushed off toward a perimeter 32 of an upper surface 26 of a body 24 of a tray portion 14, as seen in FIG. 11.

Figure 27A:
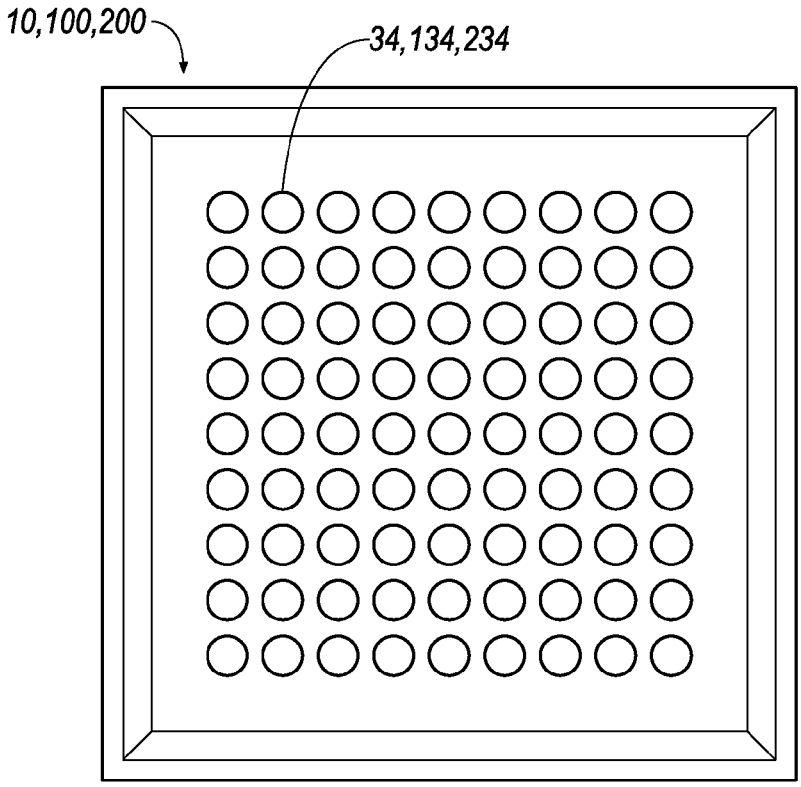
FIG. 27A illustrates a top view of the decorative object arrangement device of FIGS. 1A, 21A and 24 showing a column and row grid of passages formed in the tray portion in accordance with an exemplary embodiment of the invention.
Figure 27B:
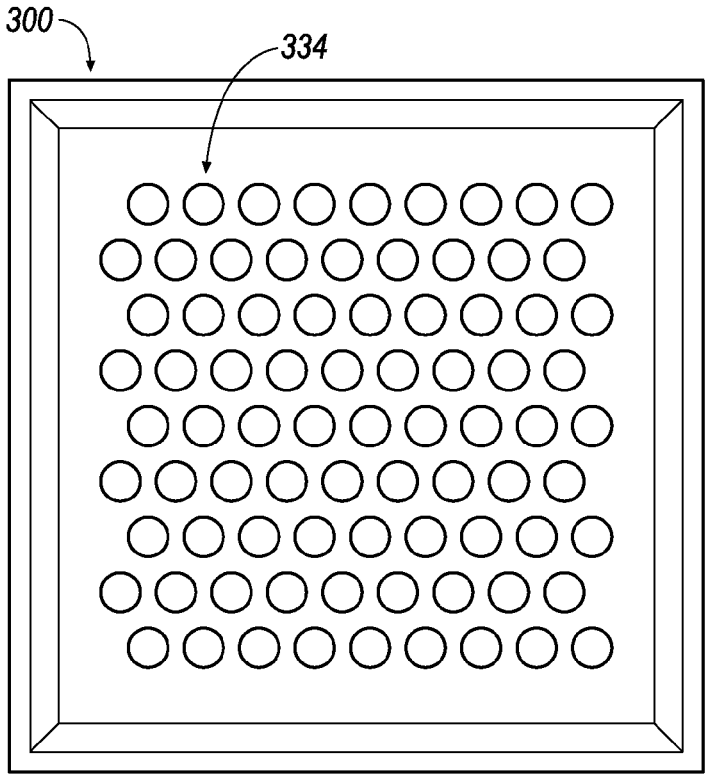
FIG. 27B illustrates a top view of a decorative object arrangement device showing staggered rows that are not arranged in a grid in accordance with an exemplary embodiment of the invention.

Referring to FIGS. 27A and 27B, it will be appreciated that the arrangement of the passages 34, 134, 234 of the decorative object arrangement devices 10, 100, 200 is not limited to a particular style. For example, although the passages 34, 134, 234 are arranged in a grid pattern, as shown in FIG. 27A, it will be appreciated that the passages 34, 134, 234 may include other arrangements. For example, as seen in FIG. 27B, passages 334 may be arranged in a "staggered row" format such that the passages 334 are not aligned in a uniform column and row, "grid" arrangement. By providing the staggered row arrangement of passages 334, it will be appreciated that it may be easier to accommodate a user wishing to arrange the decorative objects, D, in substantially non-square patterns (e.g., substantially circular patterns).

In an embodiment, it will be appreciated that the decorative objects, D, utilized with any of the decorative object arrangement devices 10, 100, 200, 300 are not limited to a particular style, shape, color or geometry. In fact, it will be appreciated that the decorative objects, D, do not necessarily have to be "decorative" (i.e., the decorative objects, D, do not necessarily have to have an aesthetically-pleasing quality).

In an embodiment, the decorative objects, D, may include, for example, a diamond simulant, which may be commonly referred to in the art as a rhinestone, "Strass" or the like and may comprise, for example, one or more of a rock, crystal, glass, acrylic, metal or the like. Although the decorative object, D, may include a diamond simulant, it will be appreciated, however, that the decorative object, D, is not limited to diamond simulants and that the decorative object, D, may include any desirable object having any desirable intrinsic/aesthetic quality, composition, color or the like (e.g., a non-precious stone, semi-precious stone, precious stone, industrial metal, non-precious metal, semi-precious metal, precious metal or the like).

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. An arrangement device, comprising:

a tray portion having a body that forms a plurality of passages; and a plurality of pattern adjustment plungers movably-secured to the tray portion within the plurality of passage, wherein an outer surface of each of the plurality of pattern adjustment plungers correspondingly contacts a surface of each of the plurality of passages to provide:

means for retaining each of the plurality of pattern adjustment plungers in one of an axially depressed orientation, and an axially non-depressed orientation, wherein each of the pattern adjustment plungers includes an upper surface, wherein the upper surface of each of the plurality of pattern adjustment plungers arranged in an axially depressed orientation is not co-planar with an upper surface of the body of the tray portion, wherein the upper surface of each of the plurality of pattern adjustment plungers arranged in an axially non-depressed orientation is substantially co-planar with the upper surface of the body of the tray portion.

2. The arrangement device according to claim 1, wherein one or more of the plurality of pattern adjustment plungers in an axially depressed orientation provide:

means for availing at least partial access to some of the plurality of passages for arranging a plurality of objects in a predetermined pattern, wherein the plurality of objects are disposed at least partially within some of the plurality of passages, and upon the upper surface of each of the plurality of axially depressed pattern adjustment plungers.

3. The arrangement device according to claim 1, further comprising:

a plunger reset plate movably-secured to the tray portion, wherein the plunger reset plate is arrangeable in selective communication with a lower surface of the plurality of pattern adjustment plungers.

4. The arrangement device according to claim 3, wherein the plunger reset plate provides:

means for resetting an orientation of at least a portion of the plurality of pattern adjustment plungers from the axially depressed orientation to the axially non-depressed orientation.

5. The arrangement device according to claim 3, further comprising:

a plurality of retaining members, and a plurality of fasteners, wherein the plurality of fasteners rigidly connect the plurality of retaining members to the body of the tray portion, wherein the plurality of retaining members retain the plunger reset plate in a selectively-movable orientation relative the tray portion.

6. The arrangement device according to claim 5, wherein the plunger reset plate is movably-disposed between, a portion of an upper surface of the plurality of retaining members, and a lower surface of the body of the tray portion.

7. The arrangement device according to claim 6, further comprising:

a plurality of locating pins extending away from the lower surface of the body of the tray portion, wherein the plunger reset plate includes a plurality of passages, wherein the plurality of locating pins are aligned with and extend through the plurality of passages of the plunger reset plate, wherein the plurality of locating pins include a height that is greater than a thickness of the plunger reset plate, wherein the height of the plurality of locating pins that is greater than a thickness of the plunger reset plate provides means for permitting the plunger reset plate to be movably-disposed about the tray portion between the portion of the upper surface of the plurality of retaining members and the lower surface of the body of the tray portion.

8. The arrangement device according to claim 1, wherein the plurality of pattern adjustment plungers include:

a plurality of flexible tab portions, wherein the plurality of pattern adjustment plungers include an substantially circumferential side surface including a first tactile feedback portion, and a second tactile feedback portion, wherein each of the first and second tactile feedback portions include a peak and a valley.

9. The arrangement device according to claim 8, wherein the plurality of passages of the body includes:

a wall surface having a substantially annular, radially-inwardly projecting ledge, wherein one of the valleys of each of the first and second tactile feedback portions may be disposed adjacent the substantially annular, radially-inwardly projecting ledge to provide means for retaining each of the plurality of pattern adjustment plungers in one of an axially depressed orientation, and an axially non-depressed orientation, wherein the substantially circumferential side surface of each of the plurality of pattern adjustment plungers includes a shoulder surface, wherein the shoulder surface provides means for preventing axial depression of each of the plurality of pattern adjustment plungers completely through each of the plurality of passages of the body.

10. The arrangement device according to claim 1, wherein the plurality of pattern adjustment plungers include:

a head portion, a shoulder portion and a neck portion, wherein the head portion is joined to a shoulder portion, wherein the shoulder portion is joined to the neck portion, wherein the shoulder portion includes a plurality of spaced, annular-shaped disks connected by a spine, wherein each disk of the plurality of spaced, annular-shaped disks includes an outer side surface defining an outer diameter, wherein the neck portion generally includes an annular-shaped disk having an upper surface, a lower surface and an outer side surface, wherein the outer side surface defines an outer diameter, wherein the diameter of the neck portion is greater than the diameter of the shoulder portion.

11. The arrangement device according to claim 10, wherein the diameter of the shoulder portion is substantially the same as an opening diameter of the passage, wherein the substantially same diameters of each of the shoulder portion and the passage provide:

means for providing a friction-fit relationship of the pattern adjustment plunger within the passage of the body of the tray portion for retaining each of the plurality of pattern adjustment plungers in one of an axially depressed orientation, and an axially non-depressed orientation.

12. The arrangement device according to claim 1, wherein the plurality of passages are aligned to form a grid of columns and rows.

13. The arrangement device according to claim 1, wherein the plurality of passages are arranged to form staggered columns and rows.

14. The arrangement device according to claim 1, further comprising:

a sheet including a predetermined pattern, wherein the sheet is disposable adjacent the upper surface of the body of the tray portion, wherein the predetermined pattern is aligned with some of the of the plurality of pattern adjustment plungers that are movably-secured within the plurality of passages to provide means for assisting a user in locating which of the plurality of pattern adjustment plungers to be moved from an axially non-depressed orientation to an axially depressed orientation.

15. The arrangement device according to claim 14, wherein the predetermined pattern is printed on the sheet to form a plurality of dots, wherein the plurality of dots define the sheet to provide:

means for indirectly engaging an upper surface of some of the pattern adjustment plungers.

16. The arrangement device according claim 14, wherein the predetermined pattern is die-cut into the sheet to form a plurality of openings extending through the sheet, wherein the plurality of openings define the sheet to provide:

means for directly engaging an upper surface of some of the pattern adjustment plungers.

17. The arrangement device according to claim 1, further comprising:

a transfer sheet including a tacky surface, wherein the tacky surface provides means for removably-securing one or more objects that is/are arranged in a predetermined pattern to the transfer sheet, wherein the transfer sheet provides means for removing the one or more objects that is/are arranged in the predetermined patter from the arrangement device.

18. The arrangement device according to claim 1, further comprising:

an upper surface of the body, wherein the body includes a lip portion that extends away from and completely encloses an outer perimeter of the upper surface of the body.

19. The arrangement device according to claim 18, further comprising:

a selectively-manipulatable lip assembly connected to the lip portion, wherein the selectively-manipulatable lip assembly includes a push rod that extends through a first passages formed in the lip portion and a second passage formed in the lip portion, a button portion connected to a first end of the push rod, a close-out member connected to a second end of the push rod, and a spring member that circumscribes a portion of the first end of the push rod and extends between the button portion and an outer surface of the lip portion.

20. The arrangement device according to claim 19, wherein the spring provides:

means for biasing the close-out member adjacent the second passage formed in the lip portion, and wherein a force applied to the button portion overcomes the biasing of the close-out member adjacent the second passage to provide means for moving the close-out member away from the second passage formed in the lip portion.

21. The arrangement device according to claim 18, wherein the upper surface of the body includes:

a substantially planar portion connected to a substantially arcuate-shaped valley portion, wherein the plurality of passages are arranged within the substantially planar portion.

22. The arrangement device according to claim 21, wherein the substantially arcuate-shaped valley portion provides:

means for collecting some objects of a plurality of objects that are not paired with one or more pattern adjustment plungers of the plurality of pattern adjustment plungers.

* * * * *